US005316898A

United States Patent [19]

Ueda et al.

[11] Patent Number: 5,316,898

[45] Date of Patent: May 31, 1994

[54] SOLID BLEACHER FOR SILVER HALIDE COLOR PHOTOGRAPHIC LIGHT SENSITIVE MATERIAL AND THE PROCESSING METHOD THEREOF

[75] Inventors: Yutaka Ueda, Hino; Hiroshi Yamashita, Hachioji, both of Japan

[73] Assignee: Konica Corporation, Tokyo, Japan

[21] Appl. No.: 21,557

[22] Filed: Feb. 24, 1993

[30] Foreign Application Priority Data

Feb. 25, 1992 [JP] Japan ..... 4-073394

[51] Int. Cl.[5] ..... G03C 5/38; G03C 7/00; G03C 5/42; G03C 5/44

[52] U.S. Cl. ..... 430/400; 430/393; 430/418; 430/428; 430/430; 430/450; 430/451; 430/461

[58] Field of Search ..... 430/393, 418, 428, 430, 430/450, 451, 458, 460, 461, 400; 252/186.1, 186.33

[56] References Cited

U.S. PATENT DOCUMENTS

| | | | |
|---|---|---|---|
| 935,156 | 9/1909 | Kelly | 430/465 |
| 2,179,292 | 11/1939 | Ham | 430/458 |
| 2,825,647 | 3/1958 | Fuller | 430/465 |
| 3,158,482 | 11/1964 | Lucas | 430/465 |
| 4,268,618 | 5/1981 | Hashimuro | 430/393 |
| 5,053,321 | 10/1991 | Kühnert | 430/393 |
| 5,063,140 | 11/1991 | Kuse et al. | 430/430 |
| 5,135,840 | 8/1992 | Reuter et al. | 430/461 |
| 5,149,618 | 9/1992 | Tappe et al. | 430/430 |
| 5,188,927 | 2/1993 | Okada et al. | 430/393 |
| 5,204,228 | 4/1993 | Yoshimoto et al. | 430/430 |
| 5,223,379 | 6/1993 | Okada et al. | 430/461 |
| 5,238,791 | 8/1993 | Tappe et al. | 430/461 |

FOREIGN PATENT DOCUMENTS

| | | | |
|---|---|---|---|
| 0396999 | 11/1990 | European Pat. Off. . | |
| 0532003 | 3/1993 | European Pat. Off. | 430/462 |
| 0534086 | 3/1993 | European Pat. Off. | 430/462 |

OTHER PUBLICATIONS

K. Ueno, "Chelate Chemistry" vol. 5, sect. 1, pp. 309,311,324 (translation).

J. Neal, N. Rose, *Inorg. Chem.*, Nov. 1968, pp. 2405–2412.

J. Majer, V. Springer, B. Kopecka, *Chem. Zvesti*, vol. 20, No. 6, pp. 414–422 (1966, Chem Abstracts, vol. 65, 1966, Abstract ∩11738f.

Derwent Abstract No. 84–145630 of USSR patent 1043137, Kostromina et al.

*Primary Examiner*—Charles L. Bowers, Jr.
*Assistant Examiner*—J. Pasterczyk
*Attorney, Agent, or Firm*—Finnegan, Henderson, Farabow, Garrett & Dunner

[57] ABSTRACT

A solid composition for bleaching an exposed and developed silver halide color photographic light-sensitive material and processing method thereof. The composition contains at least one kind of ferric complex salt and is in the form of a tablet having a bulk density of 1.0 to 2.5 g/cm$^3$. The composition provides excellent solubility and preservability.

7 Claims, 2 Drawing Sheets

SOLID BLEACHER FOR SILVER HALIDE COLOR PHOTOGRAPHIC LIGHT SENSITIVE MATERIAL AND THE PROCESSING METHOD THEREOF

FIELD OF THE INVENTION

The present invention relates to a processing composition for silver halide color photographic light sensitive materials and the processing method thereof. Particularly, the present invention relates to a solid composition for bleaching silver halide color photographic light sensitive materials, which has excellent solubility and bleaching characteristics, and to a method for processing silver halide color photographic light sensitive materials, which is environmentally suitable on a global scale and promotes labor safety and hygiene.

BACKGROUND OF THE INVENTION

The processing steps for silver halide color photographic light sensitive materials are basically comprised of a color developing step and a desilvering step. The desilvering step is comprised of a bleaching step and a fixing step or a bleach-fixing step. Other processing steps, such as rinsing steps and stabilizing steps may be added as additional processing steps.

Silver halides exposed to light are reduced to silver in a color developing step, and at the same time, an oxidized aromatic primary amine developing agent forms a dye upon reaction with a coupler. In the desilvering step, the reduced silver, oxidized in the color developing step, is then dissolved out in the form of silver ions into a processing solution.

As light sensitive materials are continuously processed, the bleacher becomes fatigued by the color developer brought into from, for example, the preceding tank. Where a continuous process is carried out using an ordinary automatic processor, means are taken to replenish the replenisher to keep the processing characteristics constant. When replenishing the replenisher, a large amount of overflow is inevitably produced and discarded, raising serious problems from both economical and pollutive viewpoints. For reducing the above-mentioned overflow, many proposals have been made and put into practical application, including a method in which a regenerant is added into the overflow so that the resulting solution may be used as a replenisher and a method in which a small amount of a concentrated replenisher is added to the processing solution.

Among these proposals, the method of regenerating an overflow requires a space for a stock tank or the like and photofinishers are required to carry out complicated operations. Particularly it is difficult to introduce this regeneration method into the increasing number of small-scale photofinishers such as on-site photofinishers (so-called mini-labs.) In contrast to the above-mentioned method, the method of replenishing with a small amount of a concentrated solution is satisfactory for small-sized photofinishers, such as mini-labs, because space is saved and extra apparatus is not needed. However, this method also has some defects.

Problems exist when dissolving a bleacher in a small amount of water to prepare a concentrated replenisher. No constant processing characteristics can be displayed, and filters provided in the circulation line become clogged with the deposition of the bleacher component or the replenishing pump is damaged because the solubility of the bleacher is low.

Further in the conventional replenishing systems, the disposal of plastic bottles commonly used is a serious problem. In Europe and America, legal limits are being imposed. For example, use of any plastics are forbidden, plastics must be recycled or decomposable plastics must be used.

To try to solve the above-mentioned problems, Japanese Patent Publication Open to Public Inspection (JP OPI Publication) No. 3-39739/1991 discloses a technique for granulating a bleacher. However, there is a high possibility the solubility of the granulated bleacher will deteriorate when aged in storage, or workers' health may be affected by dispersion of the fine powder of the granulated bleacher during dissolution.

JP OPI Publication No. 51-61837/1976 proposes a tablet-shaped processing composition capable of displaying the advantages of a dried composition. An inherent defect of a tablet-shaped composition is that the solubility thereof is inferior to granulated compositions. However, this patent discloses a technique whereby an expansion-cracking aqueous colloid is contained in a tablet-shaped chemical, to enhance the solubility of the tablet in water. However, when the macromolecular polymerized colloid was used, the bleaching characteristics of the tablet deteriorated under current rapid-processing conditions. It has, therefore, been difficult to use conventional techniques to provide any solid compositions having excellent solubility and rapid bleaching characteristics.

Another problem is that the above-mentioned conventional solid bleaching compositions have a low degree of moisture tolerance and, when stored for a long period, moisture must be shut out by sealing with vinyl, plastic or aluminum foil. This provides not only problems of discarding the packaging materials used which still remain unsolved, but also requires special air-conditioning systems for the manufacturing of the compositions and the packaging steps.

SUMMARY OF THE INVENTION

It is, therefore, an object of the invention to provide a solid bleaching composition excellent in both solubility and preservability.

Another object of the invention is to provide a solid bleaching composition excellent in bleaching function.

A further object of the invention is to provide a processing technique suitable for maintaining the global environment.

A still further object of the invention is to provide a processing technique which promotes labor safety and hygiene.

It was discovered that the above-mentioned objects of the invention can be achieved with a solid bleaching composition for silver halide color photographic light sensitive materials containing at least one kind of the ferric complex salts of the compounds represented by the following Formula (A-I), (A-II), (A-III), (A-IV), (A-V) or (A-VI) and at least one kind of the compounds represented by the following formula (II) or (III).

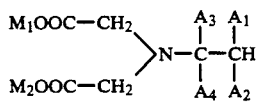

Formula (A-I)

wherein $A_1$ to $A_4$ may be the same with or the different from each other and represent each a hydrogen atom, a hydroxy group, —COOM, $—PO_3(M_1)_2$, $—CH_2COOM_2$, $—CH_2OH$ or a lower alkyl group, provided that at least one of $A_1$ to $A_4$ represents —COOM, $—PO_3(M_1)_2$ or $—CH_2COOM_2$; and M, $M_1$ and $M_2$ represent each a hydrogen atom, an ammonium group, an alkali metal or an organic ammonium group.

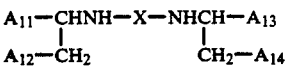

Formula (A-II)

wherein $A_{11}$ to $A_{14}$ may be the same with or the different from each other and represent each $—CH_2OH$, $—COOM_3$ or $—PO_3(M_4)_2$; $M_3$ and $M_4$ represent each a hydrogen atom, an ammonium group, an alkali metal or an organic ammonium group; X represents an alkylene group having 2 to 6 carbon atoms or $—(B_1O)_n—B_2—$ in which n is an integer of 1 to 8 and $B_1$ and $B_2$ may be the same with or the different from each other and represent each an alkylene group having 1 to 5 carbon atoms.

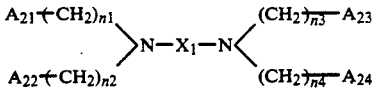

Formula (A-III)

wherein $A_{21}$ to $A_{24}$ represent may be the same with or the different from each other and represent each $—CH_2OH$, $—COOM_5$ or $—PO_3(M_6)_2$; $M_5$ and $M_6$ represent each a hydrogen atom, an ammonium group, an alkali metal or an organic ammonium group; $X_1$ represents a straight-chained or branched alkylene group having 2 to 6 carbon atoms, a saturated or unsaturated organic group capable of forming a ring or $—(B_{11}O)_{n5}—B_{12}—$ in which n is an integer of 1 to 8 and $B_{11}$ and $B_{12}$ may be the same with or the different from each other and represent each an alkylene group having 1 to 5 carbon atoms; and $n_1$ to $n_4$ is an integer of one or more and may be the same with or the different from each other.

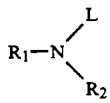

Formula (A-IV)

wherein $R_1$ and $R_2$ represent each a hydrogen atom, a substituted or unsubstituted alkyl or aryl group; L represents either one of the following formulas,

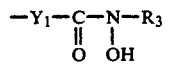

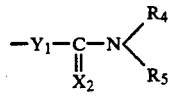

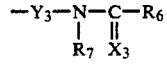

wherein $Y_1$ to $Y_3$ represent each an alkylene or arylene group; $X_2$ and $X_3$ represent each an oxygen atom or a sulfur atom; and $R_3$ to $R_7$ represent each a hydrogen atom, an alkyl group or an aryl group.

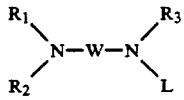

Formula (A-V)

wherein $R_1$ to $R_3$ represent each a hydrogen atom, a substitutable alkyl or aryl group; L is synonymous with the L denoted in the foregoing Formula (A-IV); and W represents a divalent linking group.

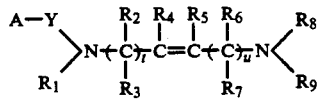

Formula (A-VI)

wherein $R_1$ to $R_3$ and $R_6$ to $R_9$ represent each a hydrogen atom or a substitutable alkyl or aryl group; $R_4$ and $R_5$ represent each a hydrogen atom, a halogen atom, a cyano group, a nitro group, an acyl group, a sulfamoyl group, a carbamoyl group, an alkoxycarbonyl group, an allyloxycarbonyl group, a sulfonyl group, a sulfinyl group or a substitutable alkyl or aryl group, provided, $R_4$ and $R_5$ may be associated so as to form a 5-membered or 6-membered ring; A represents a carboxy group, a phosphono group, a sulfo group, a hydroxy group or an alkyl metal salt or ammonium salt thereof; Y represents an alkylene group or an arylene group, provided, Y may have a substituent; and t and u are each an integer of 0 or 1.

$X_2—A_2—COOM_2$ wherein $X_2$ represents a halogen atom, an amino group, a hydroxy group, a methoxy group, $—COOM_2$ or $—SO_3M_2$; $A_2$ represents an alkylene, alkenylene or arylene group which may form a saturated or unsaturated ring, provided, $A_2$ may have a substituent; and $M_2$ represents a hydrogen atom, an ammonium group, an alkali metal or an organic ammonium group.

$NH_2—A_3—SO_3M_3$ wherein $A_3$ represents an alkylene, alkenylene or arylene group which may form a saturated or unsaturated ring, provided, $A_3$ may have a substituent; and $M_3$ represents a hydrogen atom, an ammonium group, an alkali metal or an organic ammonium group.

In the invention, the above-mentioned solid bleaching composition is desirable to be a tablet consisting of one part. In the above-mentioned solid bleaching composition, the ratio of the ammonium ions thereof to the whole cation thereof is to be preferably not more than 50 mol % and more preferably not more than 20 mol %. Further, the above-mentioned solid bleaching composition preferably contains a carbonate or a bicarbonate.

The method of processing the silver halide color photographic light sensitive material relating to the invention, which is capable of achieving the foregoing objects, is characterized in that the above-mentioned solid bleaching compositions are used when color development of the silver halide color photographic light sensitive materials is carried out, followed by bleaching or bleach-fixing treatment.

Figure 1:
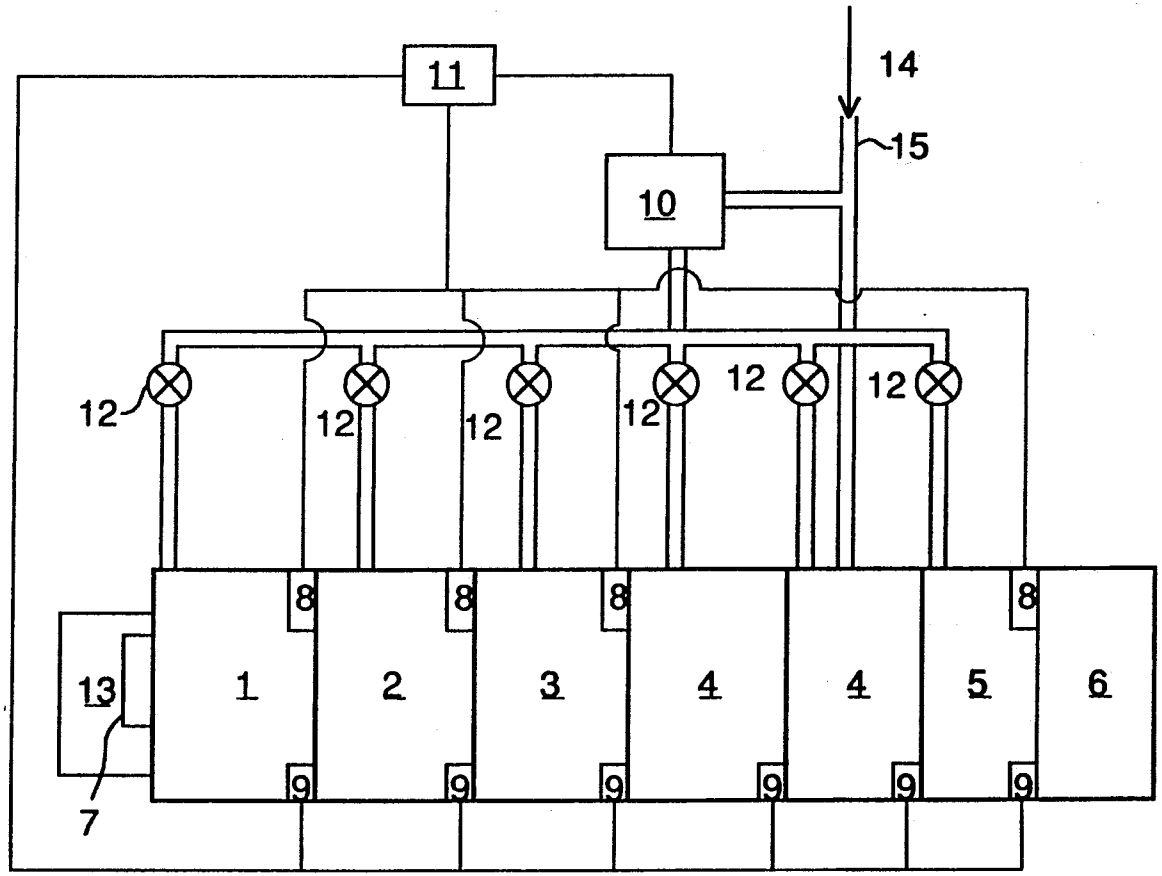
FIG. 1 is a schematic plan view showing one example of the automatic processors applicable to the invention.

1: Color developing tank,
2: Bleaching tank,
3: Fixing tank,
4: Washing tank,
5: Stabilizing tank,
6: Drying section,
7: Light sensitive material area detection sensor,
8: Solidified photographic processing chemical replenishment device,
9: Liquid level detection sensor,
10: Water replenishing tank,
11: Control section,
12: Replenishment water supply device,
13: Light sensitive material feed-in section,
14: Warm washing water,
15: Water replenishment pipe,
16: Processing tank,
17: Processing solution,
18: Circulation pump,
19: Thermostat,
20: Sub-tank,
21: Filter,
22: Cam,
23: Solidified photographic processing chemical pushing claw,
24: Solidified replenishing compositions,
25: Cartridge,
26: Solidified replenishment chemical pushing spring,
28: Overflow outlet

DETAILED DESCRIPTION OF THE INVENTION

First, the compounds represented by Formula (A-I) will be detailed. The typical examples of the compounds represented by Formula (A-I) will be given below. The compounds represented thereby shall not, however, be limited thereto.

A-I-1

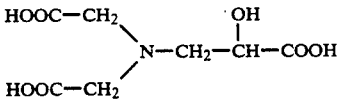

A-I-2

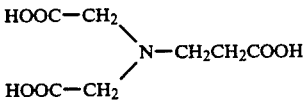

A-I-3

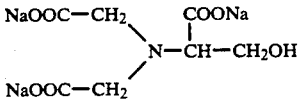

A-I-4

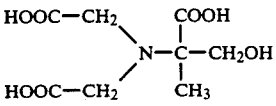

-continued

A-I-5

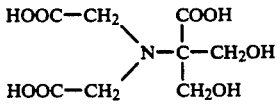

A-I-6

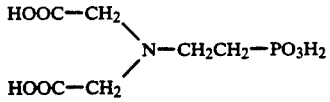

A-I-7

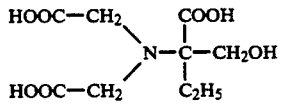

A-I-8

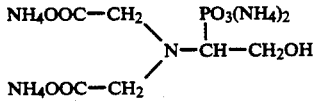

A-I-9

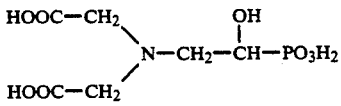

A-I-10

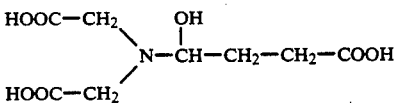

A-I-11

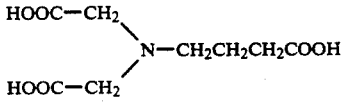

A-I-12

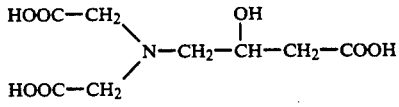

A-I-13

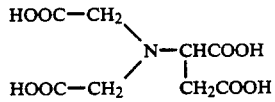

A-I-14

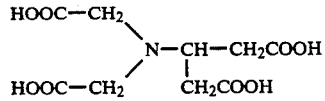

A-I-15

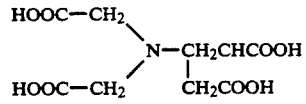

The compounds represented by the above-given Formula (A-I) can be synthesized in any ordinary synthesizing methods detailed in, for example, JP OPI Publication Nos. 63-267750/1988, 63-267751/1988, 2-115172/1990 and 2-295954/1990.

Among the compounds given above, those desirably applicable to the invention include the exemplified compounds (A-I-1), (A-I-2), (A-I-13) and (A-I-15).

Next, the compounds represented by Formula (A-II) will be detailed below.

In the above-given Formula (A-II), the alkylene groups represented by X include, for example, the groups of ethylene, propylene or butylene. In ($B_1O$)-

$_n$—$B_2$ represented by X, the alkylene groups represented by $B_1$ and $B_2$ include, for example, methylene, ethylene and trimethylene. These alkylene groups may also have a substituent including, for example, a lower alkyl group such as a methyl group, an ethyl group, or a hydroxy group.

The typical examples of the compounds represented by the foregoing Formula (A-II) will be given below. The compounds represented thereby shall not, however, be limited thereto.

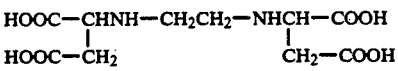
A-II-1

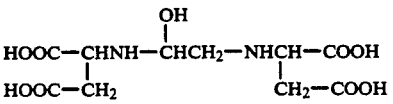
A-II-2

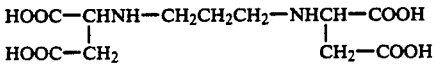
A-II-3

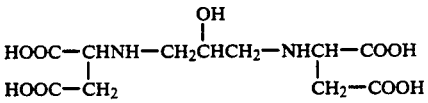
A-II-4

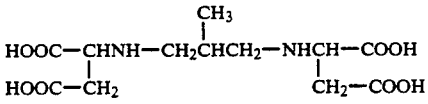
A-II-5

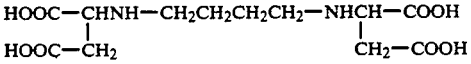
A-II-6

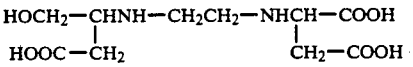
A-II-7

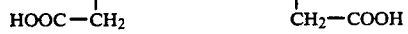
A-II-8

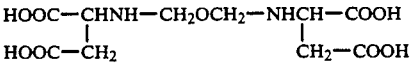
A-II-9

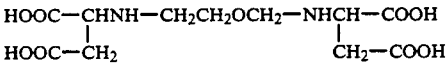
A-II-10

-continued

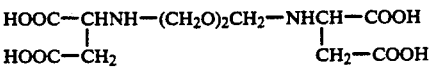
A-II-11

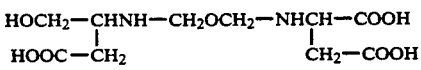
A-II-12

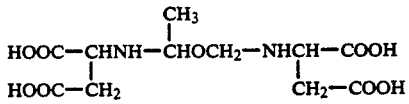
A-II-13

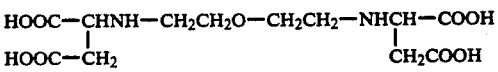
A-II-14

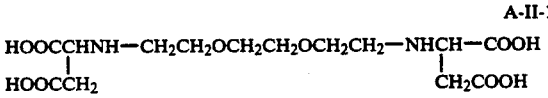
A-II-15

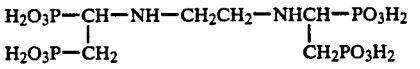
A-II-16

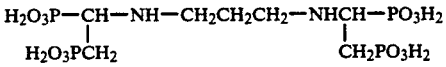
A-II-17

The compounds represented by the foregoing Formula (A-II) can be synthesized in any commonly known method.

Among the above-given compounds, the particularly desirable compounds include, for example, (A-II-1), (A-II-3) and (A-II-14).

The compounds represented by Formula (A-III) will be detailed below.

In the foregoing Formula (A-III) and in $(B_{11}O)_{n-5}$—$B_{12}$ representing $X_1$, the alkylene groups represented by $B_{11}$ and $B_{12}$ include, for example, those of methylene, ethylene and trimethylene. These alkylene groups may have a substituent including, for example, a lower alkyl group such as a methyl group and an ethyl group, and a hydroxy group.

The typical examples of the compounds represented by the foregoing Formula (A-III) will be given below. The compounds represented thereby shall not, however, be limited thereto.

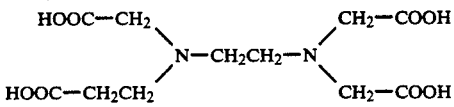
A-III-1

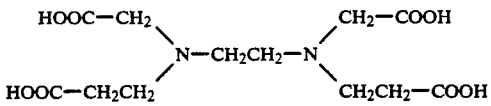
A-III-2

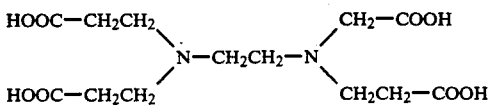
A-III-3

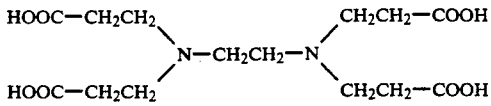
A-III-4

-continued
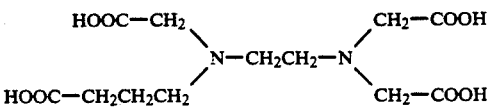
A-III-5
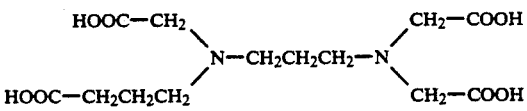
A-III-6
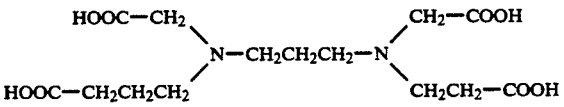
A-III-7
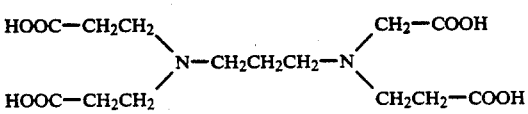
A-III-8
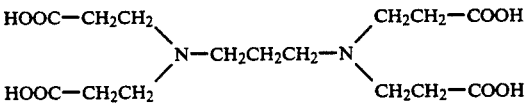
A-III-9
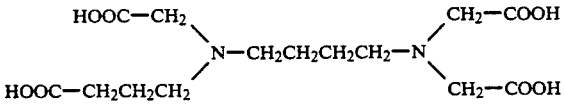
A-III-10
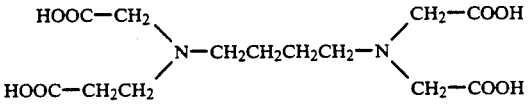
A-III-11
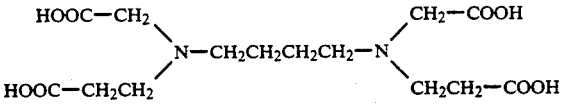
A-III-12
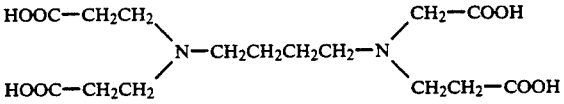
A-III-13
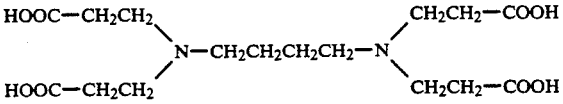
A-III-14
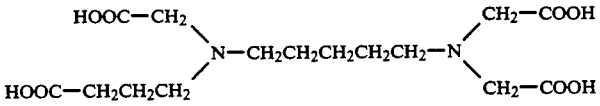
A-III-15
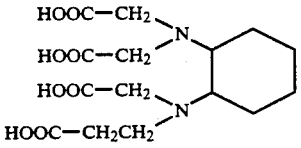
A-III-16

-continued
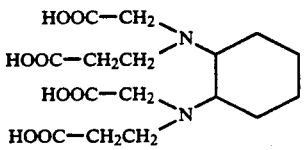
A-III-17
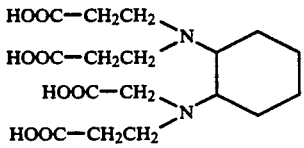
A-III-18
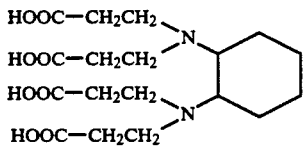
A-III-19
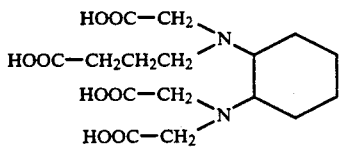
A-III-20
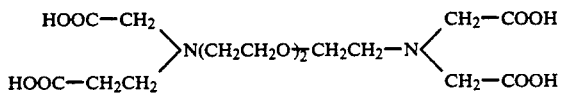
A-III-21
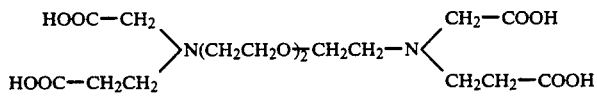
A-III-22
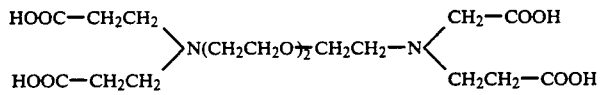
A-III-23
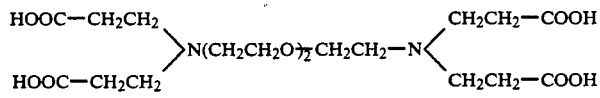
A-III-24
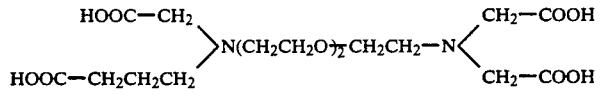
A-III-25
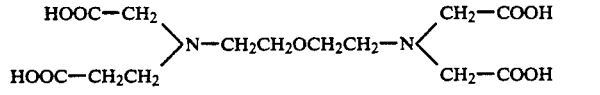
A-III-26
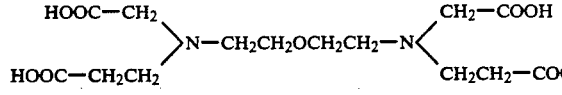
A-III-27
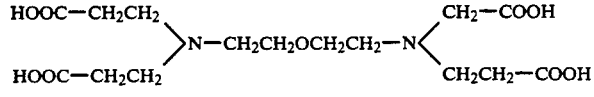
A-III-28
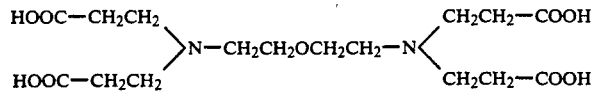
A-III-29

-continued

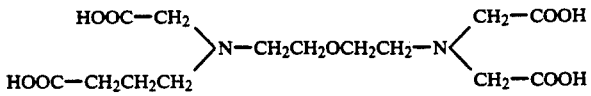
A-III-30

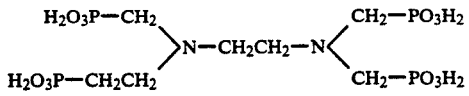
A-III-31

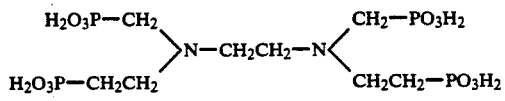
A-III-32

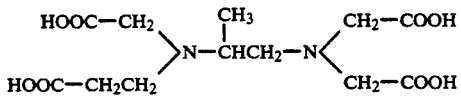
A-III-33

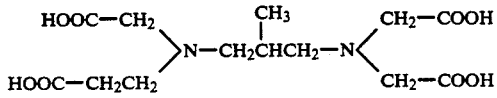
A-III-34

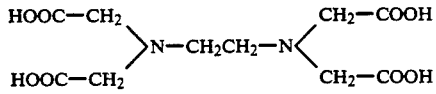
A-III-35

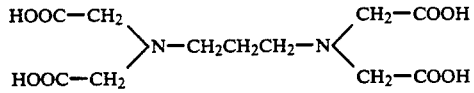
A-III-36

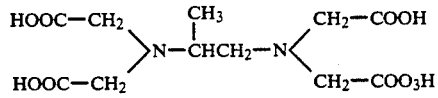
A-III-37

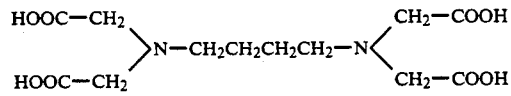
A-III-38

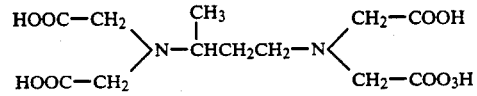
A-III-39

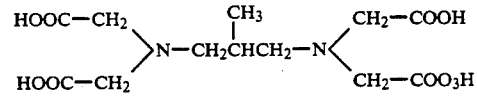
A-III-40

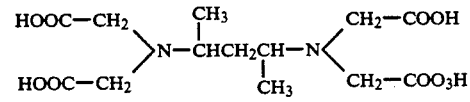
A-III-41

The above-given (A-III-16), (A-III-17), (A-III-18), (A-III-19) and (A-III-20) are each to have both of a trans form and a cis form.

Among the above-given typical examples, the particularly desirable compounds include, for example (A-III-1), (A-III-2), (A-III-6), (A-III-35), (A-III-36), (A-III-37) and (A-III-38).

Now, the compounds represented by Formula (A-IV) will be detailed.

In the above-given Formula (A-IV), the alkyl groups represented by $R_1$ and $R_2$ include, for example, those of the straight-chained, the branched and the cyclic, each having 1 to 10 carbon atoms and, among them, a methyl group and an ethyl group are particularly desirable. The aryl groups represented by $R_1$ and $R_2$ include, preferably, a phenyl group. When $R_1$ and $R_2$ represent each an alkyl or aryl group, each of these groups may have a substituent. The substituents for $R_1$ and $R_2$ include, for example, an alkyl group, an aralkyl group, an alkenyl group, an alkinyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, a phosphono group, an alkoxycarbonyl group, an aryloxycarbonyl group, an acyl group, an acyloxy group, a carbonamido group, a sulfonamido group and a nitro group. Among them, the desirable substituents include those having the following formulas.

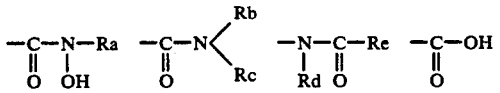

wherein Ra, Rb, Rc, Rd and Re represent each a hydrogen atom, an alkyl group or an aryl group.

In the above-given Formula (A-IV), the alkylene groups represented by $U_1$ through $Y_3$ include, for example, a methylene group, an ethylene group or a propylene group. The arylene groups represented thereby include, for example, a phenylene group. Each of the alkylene groups and arylene groups represented by $Y_1$ through $Y_3$ may have each a substituent. The substituents applicable thereto include, for example, those given for the substituents to $R_1$ and $R_2$ and, among these substituents, the following substituents are desirable.

—OH,

—COOH, $—CH_2COOM$, $—CH_2OH$, $—CONH_2$, $—CH_2CONH_2$ and $—CONHCH_3$ (in which M represents a hydrogen atom, an alkali metal or an ammonium group.)

Among the compounds represented by Formula (A-IV), the desirable ones include, for example, the compounds represented by the following Formula (B-I) or (B-II).

Formula (B-I)

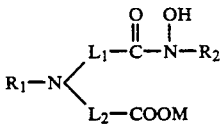

wherein $R_1$ and $R_2$ represent each a hydrogen atom, an alkyl group or an aryl group; $L_1$ and $L_2$ represent each an alkylene group or an arylene group; and M represents a hydrogen atom, an alkali metal, an ammonium group or an organic ammonium group.

Formula (B-II)

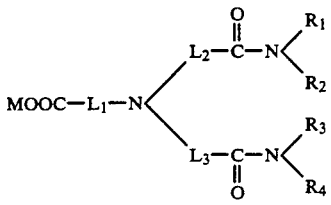

wherein $R_1$ through $R_4$ are each synonymous with $R_1$ and $R_2$ denoted in Formula (B-I); and $L_1$ through $L_3$ and M are each also synonymous with those denoted in Formula (B-I). The typical examples of the compounds represented by the foregoing Formula (A-IV) will be given below. The compounds represented thereby shall not however be limited thereto.

A-IV-1

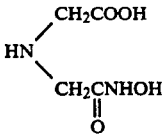

A-IV-2

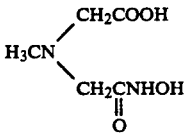

A-IV-3

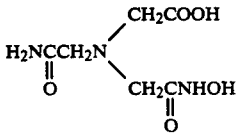

A-IV-4

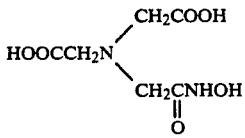

A-IV-5

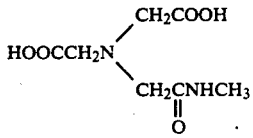

A-IV-6

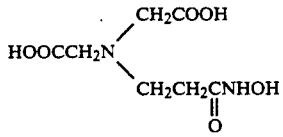

A-IV-7

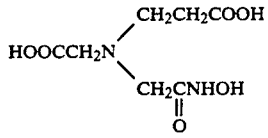

A-IV-8

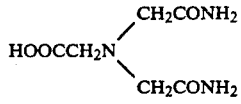

A-IV-9

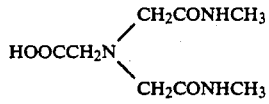

A-IV-10

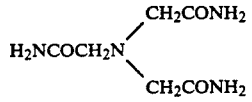

A-IV-11

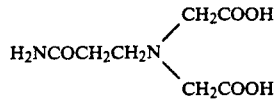

-continued

A-IV-12

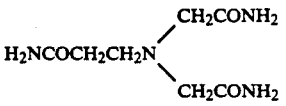

A-IV-13

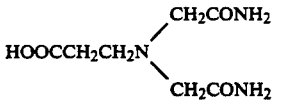

A-IV-14

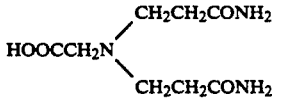

A-IV-15

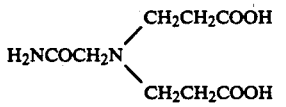

A-IV-16

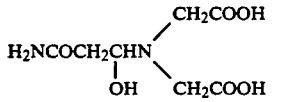

A-IV-17

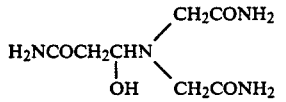

A-IV-18

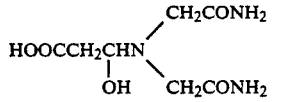

A-IV-19

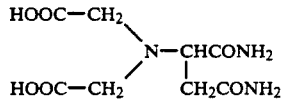

A-IV-20

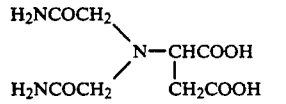

A-IV-21

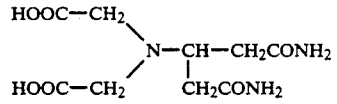

A-IV-22

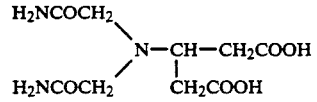

A-IV-23

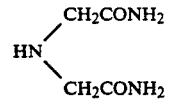

A-IV-24

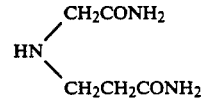

A-IV-25

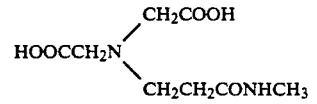

-continued

A-IV-26

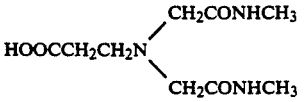

A-IV-27

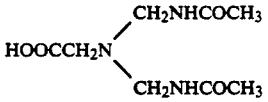

A-IV-28

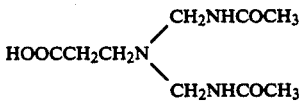

A-IV-29

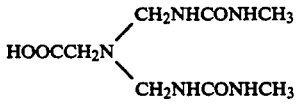

A-IV-30

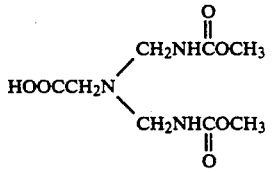

Among the above-given compounds, the particularly desirable ones include, for example, (A-IV-1), (A-IV-8), (A-IV-13), (A-IV-19), (A-IV-20), (A-IV-21) and (A-IV-22).

Now, the compounds represented by Formula (A-V) will be detailed below.

In the above-given Formula (A-V), the alkyl and aryl groups each represented by $R_1$ through $R_3$ include the same groups represented by $R_1$ and $R_2$ denoted in Formula (A-IV), and the substituents thereto are the same as mentioned above. In the above-mentioned Formula (A-V), the alkylene and arylene groups represented by $Y_1$ through $Y_3$ include the same groups as those represented by $Y_1$ through $Y_3$ denoted in Formula (A-IV), and the substituents thereto are the same as mentioned above.

In the foregoing Formula (A-V), the divalent linking groups represented by W include, desirably, an alkylene group having 2 to 8 carbon atoms (including a cyclohexylene group), an arylene group having 6 to 10 carbon atoms, $$-(B_1O)_n B_2-$$

wherein $B_1$ and $B_2$ represent each an alkylene or arylene group and n is an integer of 1 to 3.

$$-B_1-\underset{\underset{Z}{|}}{N}-B_2-$$

wherein Z represents a hydrogen atom, an unsubstituted alkyl or aryl group, or an alkyl or aryl group substituted with —COOM, —$SO_3M$ or —OH; and M represents a hydrogen atom, an alkali metal or an ammonium group. These divalent linking groups may be combined with each other.

Among the compounds represented by Formula (A-V), the desirable ones include the compounds represented by the following Formula (B-III) or (B-IV).

Formula (B-III)

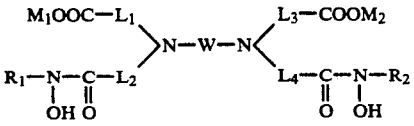

wherein $R_1$ and $R_2$ represent each a hydrogen atom, an alkyl group or an aryl group; $L_1$ through $L_4$ represent each an alkylene group or an arylene group; and $M_1$ and $M_2$ represent each a hydrogen atom, an alkali metal, an ammonium group or an organic ammonium group.

Formula (B-IV)

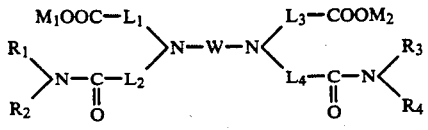

wherein $R_1$ through $R_4$ are each synonymous with $R_1$ and $R_2$ each denoted in Formula (B-III), and $L_1$ through $L_4$ and $M_1$ and $M_2$ are each synonymous with those denoted in Formula (B-III).

The typical examples of the compounds represented by the foregoing Formula (A-V) will now be given below. The compounds represented thereby shall not however be limited thereto.

A-V-1

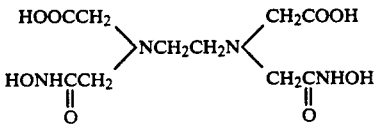

A-V-2

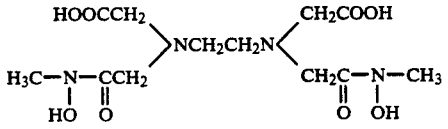

A-V-3

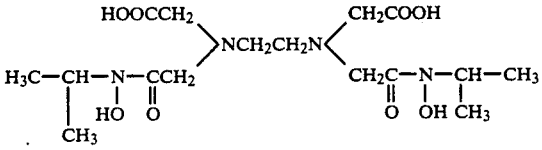

A-V-4

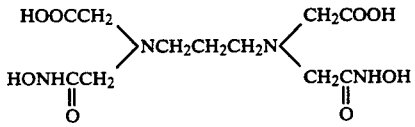

A-V-5

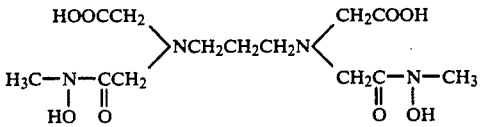

A-V-6

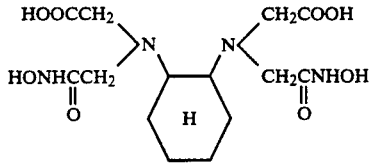

A-V-7

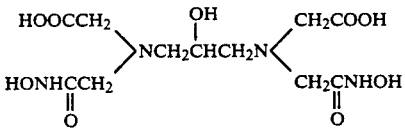

A-V-8

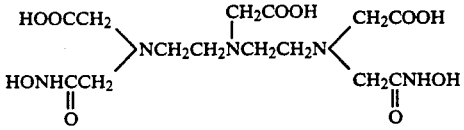

A-V-9

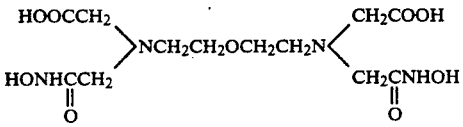

A-V-10

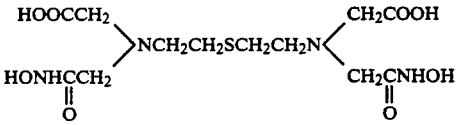

A-V-11

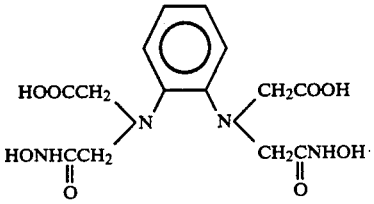

A-V-12

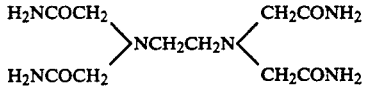

A-V-13

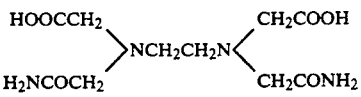

A-V-14

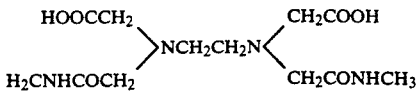

-continued
A-V-15
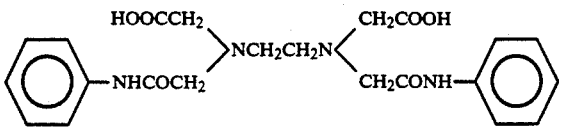
A-V-16
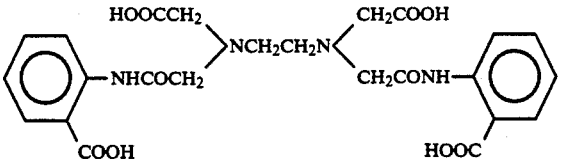
A-V-17
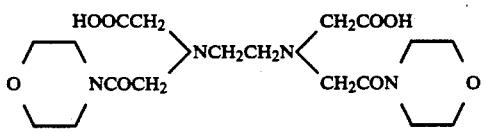
A-V-18
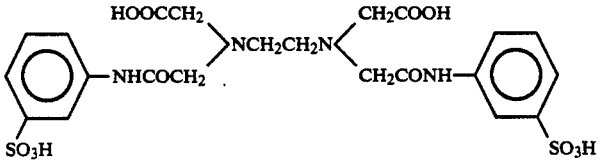
A-V-19
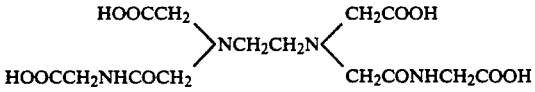
A-V-20
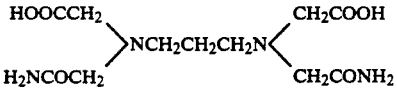
A-V-21
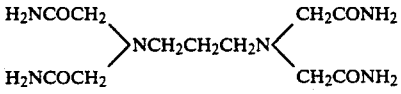
A-V-22
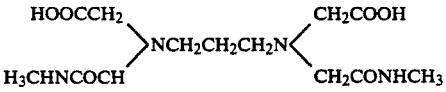
A-V-23
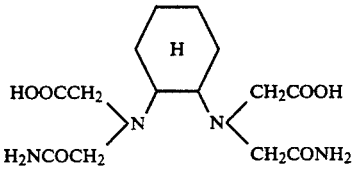
A-V-24
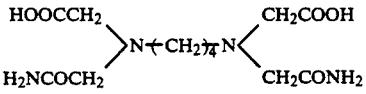
A-V-25
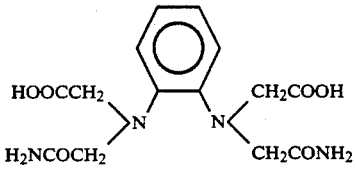
A-V-26
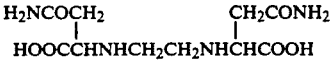
A-V-27
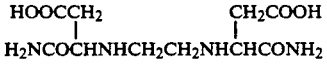
A-V-28
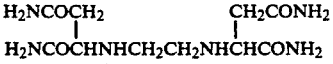
A-V-29
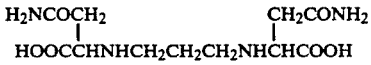
A-V-30
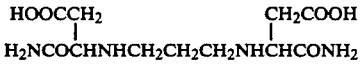
A-V-31
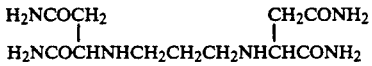
A-V-32
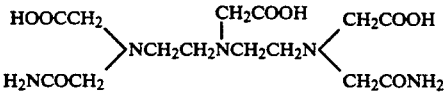
A-V-33
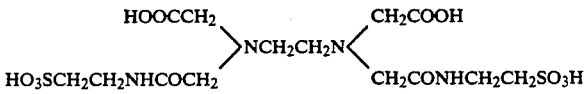
A-V-34
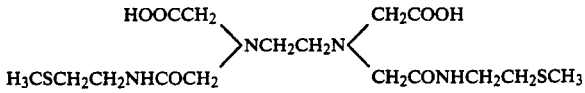

-continued

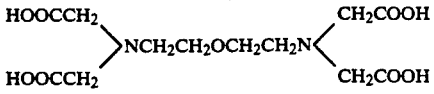

A-V-35

It is remarkably effective when containing the iron salts of the compounds represented by Formulas (A-I), (A-II) and (A-III).

Among these compounds, the particularly desirable compounds include those represented by (A-V-1), (A-V-4), (A-V-6), (A-V-13), (A-V-16), (A-V-20), (A-V-23), (A-V-26), (A-V-27), (A-V-29), (A-V-30) and (A-V-33).

Next, the compounds represented by Formula (A-VI) will be detailed below.

The typical examples of the compounds represented by Formula (A-VI) will be given below. The compounds represented thereby shall not however be limited thereto.

A-VI-1

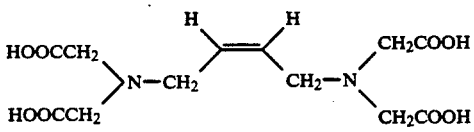

A-VI-2

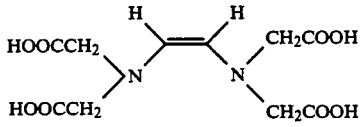

A-VI-3

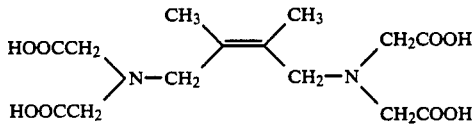

A-VI-4

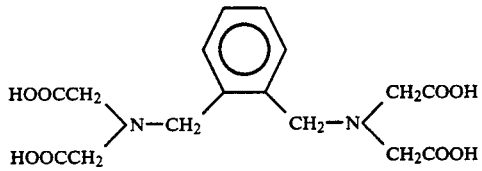

A-VI-5

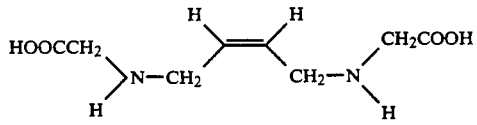

A-VI-6

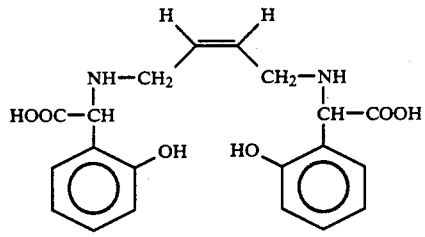

A-VI-7

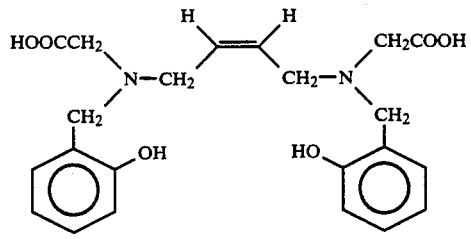

A-VI-8

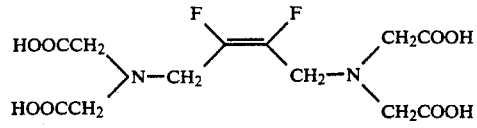

-continued

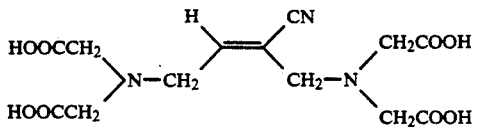

A-VI-9

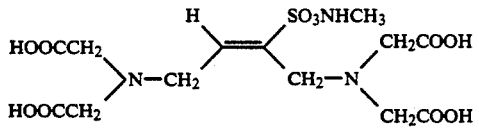

A-VI-10

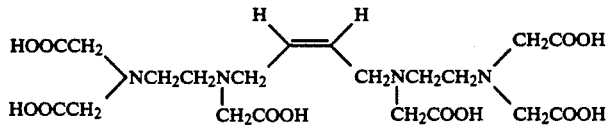

A-VI-11

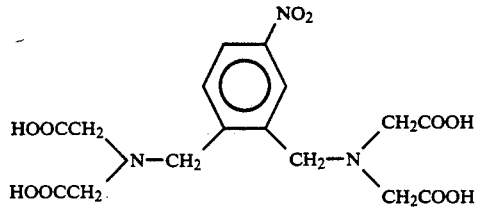

A-VI-12

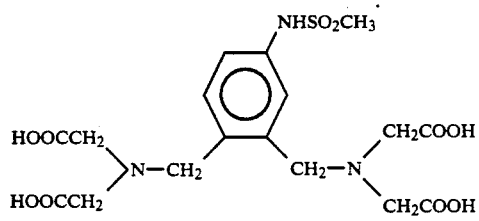

A-VI-13

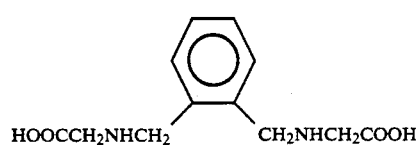

A-VI-14

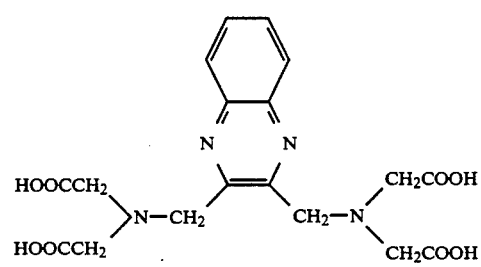

A-VI-15

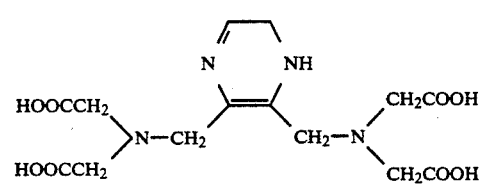

A-VI-16

Among these compounds, the particularly desirable compounds include (A-VI-1), (A-VI-3), (A-VI-4) and (A-VI-16).

The compounds represented by the above-given Formulas (A-I) through (A-VI) may be added in an amount within the range of, preferably 0.01 to 1 mol per liter of a processing solution used and, more preferably 0.05 to 0.6 mols per liter of a processing solution used.

Next, the typical examples of the compounds represented by Formulas (II) and (III) will be given below. These compounds shall not however be limited thereto.

$HOOCCH_2C(OH)(COOH)CH_2COOH$, (II-1)
$HOOC(CHOH)_2COOH$, (II-2)
$HOOCCH_2COOH$, (II-3)
$HOOCCH(OH)CH_2COOH$, (II-4)
$HOOCCH{=}CHCOOH$, (II-5)
$HOOCCH_2CH_2COOH$, (II-6)
$(COOH)_2$, (II-7)

(II-8)

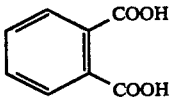

(II-9)

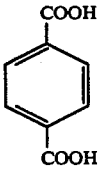

$NaOOCCH{=}CHCOONa$, (II-10)
$KOOCCH{=}CHCOOK$, (II-11)
$H_4NOOCCH{=}CHCOONH_4$, (II-12)

(II-13)

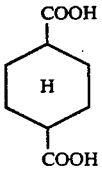

(II-14)

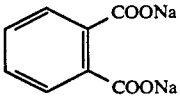

(II-15)

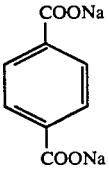

$HOOC(CH_2)_3COOH$ (II-16)

$H_2C{=}C(CH_2COOH)COOH$, (II-17)

$H_3C{-}C(COOH){=}CH{-}COOH$ (II-18)

$HOOCCH_2CH(CH_3)COOH$, (II-19)
$HOCH_2COOH$, (II-20)
$ClCH_2COOH$, (II-21)
$NH_2CH_2COOH$, (II-22)
$HOCH_2CH_2COOH$, (II-23)

$HOCH(CH_3)COOH$, (II-24)

$NH_2CH_2CH_2COOH$, (II-25)

$NH_2CH(CH_3)COOH$ (II-26)

$HOCH{=}CHCOOH$, (II-27)
$NH_2CH{=}CHCOOH$, (II-28)

-continued (II-29)

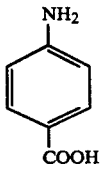

(II-30)

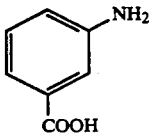

(II-31)

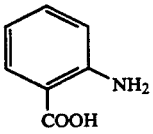

(II-32)

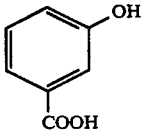

(II-33)

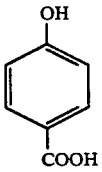

(II-34)

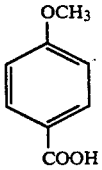

(II-35)

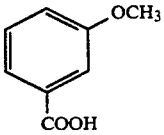

$NH_2CH_2SO_3H$ (III-1)
$NH_2CH_2CH_2SO_3H$ (III-2)

$NH_2CH(CH_3)SO_3H$ (III-3)

(III-4)

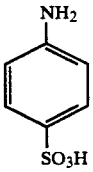

(III-5)

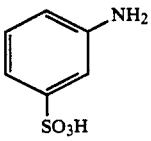

Among the above-given compounds, the preferable compounds include, Exemplified Compounds (II-3), (II-5), (II-6), (II-10), (II-11), (II-12), (II-16), (II-17), (II-18), (II-19) and (III-4) and, more preferable compounds include (II-5), (II-6) and (II-16). It is one of the desirable embodiments to make combination use of two or more kinds of the compounds represented by these Formulas (II) and (III) for keeping the desired pH of a bleacher. The above-given compounds are used in a form of a sodium salt or a potassium salt and, desirably in the form of a potassium salt.

The compounds represented by the foregoing Formulas (II) and (III) may be added in an amount within the range of, desirably 0.05 to 1 mol per liter of a processing solution used and, more desirably 0.1 to 0.6 mols per liter of a processing solution used.

From the viewpoints of the effects of the invention, the bleachers of the invention are desired not to contain any acetic acid and any acetate substantially.

The bleachers of the invention are allowed to contain an excessive amount of chelating agents to the iron ion contained in the bleachers, besides the ferric complex salts of the compounds represented by the foregoing Formulas (A-I), (A-II), (A-III), (A-IV), (A-V) and (A-VI). When this is the case, the free chelating agents are preferably the compounds represented by the foregoing Formulas (A-I), (A-II), (A-III), (A-IV), (A-V) and (A-VI). However, they may also be the other generally known chelating agents than the above-mentioned chelating agents.

Besides the above-mentioned compounds, the bleachers of the invention may further contain a halide such as ammonium bromide, potassium bromide or sodium bromide, a nitrate such as ammonium nitrate or potassium nitrate, and various kinds of fluorescent whitening agents, defoaming agents or surfactants.

It is desirable from the handling viewpoint that the solid bleaching composition of the invention is to be comprised of one and single part that is a single kind of a tablet containing the whole component necessary to bleach silver halide color photographic light sensitive materials. When this is the case, it is also allowed to embody a layered form in which some compounds of the tablet components easily reactable with each other are partitioned off with an inert compound, a film or the like.

In the invention, the ammonium ion proportion of a solid bleaching composition to the whole cation thereof is preferably not more than 50 mol % and, more preferably, not more than 20 mol %, from the viewpoints of the aging preservation of the solid bleaching composition and the odor prevention when the bleachers are dissolved to be a processing solution.

When the solid bleaching composition of the invention contain a carbonate, the solubility thereof can further be improved. When the solid bleaching composition relating to the invention are granulated in advance of preparing them, it is preferable to granulate the compounds represented by Formulas (II) and (III) and a carbonate separately.

The color developers applicable to the processing methods relating to the invention are desired to contain a paraphenylene diamine type color developing agent. For the compounds of the color developing agents desirably applicable to the invention, the typical exemplified compounds thereof include (C-1) through (C-16) given in JP O.P.I. Publication No. 4-86741/1992, pp. 26 to 31; (1) through (8) given in JP OPI Publication No. 61-289350/1986, pp. 29 to 31; and (1) through (26) given in JP OPI Publication No. 3-246543/1991, pp. 5 to 9; and, more desirably, (C-1) and (C-3) given in JP O.P.I. Publication No. 2-203169/1990; Exemplified Compound (2) given in JP O.P.I. Publication No. 61-289350/1986; and Exemplified Compound (1) given in JP OPI Publication No. 3-246543/1991.

The color developers relating to the invention are also allowed to contain a hydroxylamine derivative, a hydrazine derivative or a reducing sugar as a preservative. It is more desirable to make combination use of a sulfite such as sodium sulfite, potassium sulfite or sodium bisulfite. Besides the above, any well-known chelating agents, fluorescent whitening agents, surfactants and halides may also be contained therein.

In the fixers relating to the invention, a thiosulfate and a thiocyanate may desirably be used as a principal fixing agent and the both of them can also be used in combination. The fixers are also allowed to contain any well-known pH buffers, chelating agents, sulfites and sulfite-releasable compounds.

From the viewpoint of the environmental aptitude, the proportion of ammonium ions to the whole cation content of a bleacher is to be desirably not more than 50% and, more desirably not more than 20%.

The stabilizers relating to the invention can contain formaldehyde. It is, however, desirable to contain formaldehyde by an aldehyde amine condensate such as hexamethylene tetramine, an N-methylol compound, hydroxybenzaldehyde and the derivatives thereof, and a formaldehyde-releasable compound, each in place of formaldehyde. Besides the above, the stabilizers relating to the invention can also contain any well-known chelating agents, surfactant, fluorescent whitening agents and antimolds.

The above-mentioned color developers, fixers and stabilizers are desirable to be replenished, to an automatic processor, in the form of a solidified processing composition as same as in the case of the bleachers of the invention. When they are in the form of tablets, the effects of the invention can be more remarkable.

In this invention, after silver halide color photographic light sensitive materials are exposed imagewise to light and when processing the light sensitive material continuously through an automatic processor, the method therefor preferably comprises the steps of adding a solid composition to a dissolving section provided at a position coming contact with a tank solution, dissolving it in water to be a solution and then replenishing the solution. The automatic processors desirably applicable to the invention are each comprised of a processing tank (so-called a main-tank) for processing a silver halide color photographic light sensitive material and a dissolving section (so-called a sub-tank) for dissolving a solid composition and each have a structural form in which the processing tank and the dissolving section are connected through and each of the solutions is circulated between the processing tank and the dissolving section by providing with a circulation means. To the above-mentioned dissolving section, it is desirable to provide a dissolving device for positively dissolving a solid chemical duly supplied. Further, it is desired to provide a filtering device to the inside of the dissolving section, so as not to prevent any influx of any impurities and any insoluble or unsoluble matters into any processing tank.

From the viewpoint of embodying the invention, it is a desirable embodiment to replenish water in an amount equivalent to the minimum water evaporation amount. To be more concrete, as a processing solution is constantly evaporated from a processing solution tank, the solution level is lowered and concentrated unless water is replenished therein, so that the problems are raised, such as the problems of deteriorating the photographic characteristics and depositing the components of a processing solution. Therefore, a minimum water replenishment is required for keeping the tank solution level. Besides the water replenishment required to compensate the evaporated amount of the tank solution, it is further required to make another water replenishment, considering the carrying-out of a solution together with a light sensitive material and diluting a waste matter eluted out of a light sensitive material and then precipitated in a processing solution. However, when a water replenishment is too much, the amount of the waste solution is so increased as not to be desirable for displaying the effects of the invention.

It is further desirable to provide an automatic processor with a means for detecting the processed quantities of silver halide color photographic light sensitive materials, a device for automatically supplying solid compositions to the foregoing dissolving section so as to meet the processed quantities of the light sensitive materials and a water replenishing device for carrying out the above-mentioned water replenishments.

When making combination use of the solid bleaching compositions and the processing method of the invention, the conventional hand-working dissolution can substantially be eliminated, so that any operators do not inhale any flying composition parts in their working time, and their hands, clothes and any equipments around there cannot be contaminated. It is also possible to supply the processing compositions having an environmental aptitude without using any plastic bottles.

In addition to the above, it is further possible to eliminate a replenishing tank and a replenisher supplying pump, each occupying almost one half space of an automatic processor, so that the apparatus can greatly be made compact.

The solid composition called in the invention includes not only a tablet, a granule and powder, but also those packed or coated with a soluble film such as an alkali-soluble or water-soluble film.

The powder called in the invention herein is the aggregate of fine crystals. The granule called in the invention is one granulating the powder, which is a granule having a particle size within the range of 50 to 5000 μm.

The tablet in the invention is one obtained by molding powder into a certain shape through compression molding, or one obtained by molding a granule formed in advance into a certain shape through compression molding.

Among the above-mentioned solidified processing compositions, the tableted chemicals are desirably used from the viewpoint of remarkably displaying the effects of the invention.

A photographic processing composition can be solidifed in any desired means such as that a conc. liquid, fine powdered or granulated photographic processing composition and a water-soluble binder are kneaded together and are then molded, and that a coated layer is formed on the surface of a temporarily molded photographic processing composition by spraying a water-soluble binder thereon. (Refer to JP O.P.I. Publication Nos. 4-29136/1992, 4-85535/1992, 4-85536/1992, 4-85533/1992, 4-85534/1992 and 4-172341/1992.)

The desirable tablet preparation processes include, for example, the process in which a powdered solid processing composition is granulated and is then tableted. This tablet preparation process is improved in solubility and preservability more than in a solid processing compositions simply prepared by mixing up the solid processing composition components and then by forming them in a tableting step. Resultingly, this process has the advantage that the photographic characteristics can also be stabilized.

As for the granulation processes for forming tablets, it is possible to use any well-known processes such as the processes of a rolling granulation, an extrusion granulation, a compression granulation, a cracking granulation, a stirring granulation, a fluidized-layer granulation and a spray-dry granulation.

The average particle size of the resulting granules applicable to the invention is to be within the range of, desirably 100 to 800 μm and, more desirably 200 to 750 μm. In the case where an average particle size is smaller than 100 μm or larger than 800 μm, the chemical components cannot be uniformed or the so-called segregation is produced, when the above-mentioned granules are mixed up and compressed. This is an undesirable phenomenon.

The granularity distribution is desirable when not less than 60% of granule particles are within the deviation range of ±100 to 150 μm.

When the resulting granules are compressed, any one of the known compressors such as a hydraulic press, a single shot tablet machine, a rotary tablet machine and a briquetting machine may be used. The resulting compressed solid processing compositions can take any forms. It is however desirable that they are cylinder-formed, that is, they are tableted, from the viewpoints of productivity and handling convenience.

It is further desired to fractionally granulate each of the components such as an alkalizer, a reducer, a bleacher and a preservative when granulating the processing chemicals. Thereby, the above-mentioned effects can more remarkably be displayed.

The tableted processing compositions can be prepared in any ordinary processes including, for example, those detailed in JP OPI Publication Nos. 51-61837/1976, 54-155038/1979 and 52-88025/1977; and British Patent No. 1,213,808. Also, the granulated processing compositions can be prepared in any ordinary processes including, for example, those detailed in JP OPI Publication Nos. 2-109042/1990, 2-109043/1990, 3-39735/1991 and 3-39739/1991. Further, the powdered processing compositions can be prepared in any ordinary processes including, for example, those detailed in JP OPI Publication No. 54-133332/1979; British Patent Nos. 725,892 and 729,862; and German Patent No. 3,733,861.

When a solid composition is of the tablet type, the bulk density of the above-mentioned solid composition is to be within the range of, preferably 1.0 g/cm$^3$ to 2.5 g/cm$^3$, from the viewpoints of the solubility thereof and the effects of the objects of the invention. When the bulk density thereof is higher than 1.0 g/cm$^3$, it is desirable from the viewpoint of the strength of the resulting solidified matters. When the bulk density thereof is lower than 2.5 g/cm$^3$, it is desirable from the viewpoint of the solubility of the resulting solidified matters. When a solidified processing composition is of the granulated or the powdered, the bulk density thereof is to be within the range of, preferably, 0.40 to 0.95 g/cm$^3$.

EXAMPLES

Example 1

A tableted replenishment composition for bleaching color negatives was prepared in the following manner.

Procedure (1)

Ferric potassium salts of the compounds represented by Formulas (A-I) through (A-VI) shown in Table 1 in an amount of 0.30 mols and 60 g of organic acid represented by Formula (II) or (III) shown in Table 1 were pulverized through an air-jet fine-pulverizer so as to have an average particle size of 10 μm. The resulting fine powder was granulated through a commercially available fluidized-bed spray granulator at room temperature for about 6 minutes by spraying 2.5 ml of water over the powder and the resulting granules were dried at 65° C. for 7 minutes, followed by drying in vacuum at 40° C. for 2 hours so as to almost completely remove the moisture of the granules.

Procedure (2)

Potassium bromide in an amount of 40 g and about 30 g of potassium carbonate were pulverized in the same manner as in Procedure (1). Water was sprayed in an amount of 0.5 ml so as to granulate them and the resulting granules were dried at 65° C. for 5 minutes, followed by drying in vacuum at 40° C. for 2 hours so as to almost completely remove the moisture of the granules. The amount of potassium carbonate was so controlled as to meet the amount of organic acid added in Procedure (1) so that the pH of the resulting tableted compositions could be controlled to be about 4 when the tablet compositions were dissolved in water.

Procedure (3)

The granules prepared in the above-mentioned Procedures (1) and (2) were uniformly mixed up together by a mixer for 10 minutes in a room controlled to be 25° C. and not higher than 40% RH. Next, the resulting mixture was compression-tableted to make a tablet having a diameter of 3 cm by making use of a solidifying tablet machine modified of Tough-Press Collect 1527HU manufactured by Kikusui Mfg. Works, Inc., so that 50 pieces of tablet-shaped replenishment compositions for color negatives could be prepared by uniformly arranging the mixture.

In the above, the granules have a bulk density of 0.65 g/cm$^2$, and the tablet compositions have a bulk density of 1.7 g/cm$^2$.

One thousand mili liter of water was put in a beaker and was then controlled to be 35° C. While water was kept stirred with a magnetic stirrer, 5 pieces of the above-obtained compositions were put therein and the solubilities thereof were evaluated. On the other hand, 2 pieces of the compositions were aged in a free state at 30° C. and 50% RH for 2 weeks and the appearance of the aged sample compositions were observed with the eye. Further, 5 pieces of the compositions were put in a polyethylene bag and sealed and then aged for 2 weeks at 65° C. and 35% RH. After that, the strength of the aged compositions were evaluated. The results thereof will be shown in Table 1.

The evaluation criteria for the solubilities shown in Table 1 are as follows.

⊙: Completely dissolved within 10 minutes;
○: Completely dissolved within 15 minutes;
Δ: Completely dissolved within 20 minutes;
×: Required 20 minutes or longer until dissolution was completed;

The evaluation criteria for the appearance of the aged samples shown in Table 1 were as follows.

○: Not found in any appearance changes between the pre-aging and aged states;
Δ: Tablets were swelled by moisture, but the tablet shapes remained unchanged;
×: The tablet shapes could not almost be kept due to the moisture.

The evaluation criteria for the strength of the aged samples shown in Table 1 were as follows.

○: Every tableted composition was not damaged at all even when dropping them on a wooden plate from the height of 1 meter;
Δ: Some tableted compositions were damaged when dropping them on a wooden plate from the height of 1 meter;
×: Every tableted composition was damaged at all when dropping them on a wooden plate from the height of 1 meter;

TABLE 1A

| No. | Bleaching agent (Exemp. compound) | Organic acid (Exemp. compound) | Solubility | Preservability | Abrasion | Remarks |
|---|---|---|---|---|---|---|
| 1-1 | (A-III-35)Fe.K | None | Δ | X | X | Comparison |
| 1-2 | " | Potassium acetate | Δ | X | X | " |
| 1-3 | " | (II-1) | ⊙ | ○ | ○ | Invention |
| 1-4 | " | (II-3) | ⊙ | ○ | ○ | " |
| 1-5 | " | (II-5) | ⊙ | ○ | ○ | " |
| 1-6 | " | (II-6) | ⊙ | ○ | ○ | " |
| 1-7 | " | (II-9) | ○ | ○ | ○ | " |
| 1-8 | " | (II-10) | ○ | ○ | ○ | " |
| 1-9 | " | (II-11) | ○ | ○ | ○ | " |
| 1-10 | " | (II-12) | ○ | ○ | ○ | " |
| 1-11 | " | (II-16) | ⊙ | ○ | ○ | " |
| 1-12 | " | (II-20) | ⊙ | Δ | ○ | " |
| 1-13 | " | (II-29) | ⊙ | ○ | ○ | " |
| 1-14 | " | (II-34) | ○ | ○ | ○ | " |
| 1-15 | " | (III-4) | ⊙ | ○ | ○ | " |
| 1-16 | (A-III-36)Fe.K | None | X | X | X | Comparison |
| 1-17 | " | Potassium acetate | X | X | X | " |
| 1-18 | " | (II-5) | ⊙ | ○ | ○ | Invention |
| 1-19 | " | (II-6) | ⊙ | ○ | ○ | " |
| 1-20 | " | (II-10) | ○ | ○ | ○ | " |
| 1-21 | " | (II-11) | ○ | ○ | ○ | " |
| 1-22 | " | (II-12) | ○ | ○ | ○ | " |
| 1-23 | " | (II-16) | ⊙ | ○ | ○ | " |
| 1-24 | " | (II-17) | ⊙ | ○ | ○ | " |

TABLE 1A-continued

| No. | Bleaching agent (Exemp. compound) | Organic acid (Exemp. compound) | Solubility | Preservability | Abrasion | Remarks |
|---|---|---|---|---|---|---|
| 1-25 | " | (II-18) | ◎ | ○ | ○ | " |
| 1-26 | " | (II-19) | ◎ | ○ | ○ | " |
| 1-27 | " | (II-20) | ◎ | Δ | ○ | " |
| 1-28 | " | (II-22) | ◎ | ○ | ○ | " |
| 1-29 | " | (II-32) | ○ | ○ | ○ | " |
| 1-30 | " | (III-4) | ◎ | ○ | ○ | " |

TABLE 1B

| No. | Bleaching agent (Exemp. compound) | Organic acid (Exemp. compound) | Solubility | Preservability | Abrasion | Remarks |
|---|---|---|---|---|---|---|
| 1-31 | (A-I-1)Fe | (II-5) | ○ | ○ | ○ | Invention |
| 1-32 | (A-I-2)Fe | " | ◎ | ○ | ○ | " |
| 1-33 | (A-I-13)Fe.K | " | ○ | ○ | ○ | " |
| 1-34 | (A-I-15)Fe.K | " | ○ | ○ | ○ | " |
| 1-35 | (A-II-1)Fe.K | " | ◎ | ○ | ○ | " |
| 1-36 | (A-II-3)Fe.K | " | ◎ | ○ | ○ | " |
| 1-37 | (A-II-14)Fe.K | " | ◎ | ○ | ○ | " |
| 1-38 | (A-III-1)Fe.K | " | ○ | ○ | ○ | " |
| 1-39 | (A-III-2)Fe.K | " | ○ | ○ | ○ | " |
| 1-40 | (A-III-37)Fe.K | " | ◎ | ○ | ○ | " |
| 1-41 | (A-III-38)Fe.K | " | ○ | ○ | ○ | " |
| 1-42 | (A-IV-1)Fe.$(NO_3)_2$ | " | ○ | Δ | Δ | " |
| 1-43 | (A-IV-8)Fe.$(NO_3)_2$ | " | ○ | Δ | Δ | " |
| 1-44 | (A-IV-13)Fe.$(NO_3)_2$ | " | ○ | Δ | ○ | " |
| 1-45 | (A-IV-20)Fe.$NO_3$ | " | ○ | Δ | ○ | " |
| 1-46 | (A-IV-22)Fe.$NO_3$ | " | ○ | Δ | ○ | " |
| 1-47 | (A-V-1)Fe.$NO_3$ | " | ○ | Δ | Δ | " |
| 1-48 | (A-V-4)Fe.$NO_3$ | " | ○ | Δ | Δ | " |
| 1-49 | (A-V-6)Fe.$NO_3$ | " | ○ | Δ | Δ | " |
| 1-50 | (A-V-13)Fe.$NO_3$ | " | ○ | Δ | Δ | " |
| 1-51 | (A-V-20)Fe.$NO_3$ | " | ○ | Δ | Δ | " |
| 1-52 | (A-V-23)Fe.$NO_3$ | " | ○ | Δ | Δ | " |
| 1-53 | (A-V-26)Fe.$NO_3$ | " | ○ | Δ | ○ | " |
| 1-54 | (A-V-27)Fe.$NO_3$ | " | ○ | Δ | ○ | " |
| 1-55 | (A-V-29)Fe.$NO_3$ | " | ○ | Δ | ○ | " |
| 1-56 | (A-V-30)Fe.$NO_3$ | " | ○ | Δ | ○ | " |
| 1-57 | (A-VI-1)Fe.K | " | ○ | Δ | Δ | " |
| 1-58 | (A-VI-3)Fe.K | " | ○ | Δ | Δ | " |
| 1-59 | (A-VI-4)Fe.K | " | ○ | Δ | Δ | " |
| 1-60 | (A-VI-16)Fe.K | " | ○ | Δ | Δ | " |

It was proved from Tables 1A and 1B that the tablet-shaped compositions of the invention were excellent in solubility and aging preservability. As for the other effects, it was also proved that they are resistive against the abrasion after preserving them.

The effects can remarkably be displayed particularly when the tablet-shaped compositions contain the iron salts of the compounds represented by Formulas (A-I), (A-II) and (A-III).

Example 2

The tablet replenishing compositions for bleaching color negatives in the following manner.

Procedure (1)

Ferric potassium salt bleacher of the compounds represented by Formula (A-III) shown in Table 1 in an amount of 0.3 mols, 30 g of succinic acid (Exemplified Compound II-6) and 35 g of maleic acid (Exemplified Compound II-5) were pulverized through an air-jet fine-pulverizer so as to have an average particle size of 10 μm. The resulting fine powder was granulated through a commercially available fluidized-bed spray granulator at room temperature for about 6 minutes by spraying 2.5 ml of water over the powder and the resulting granules were dried at 65° C. for 7 minutes, followed by drying in vacuum at 40° C. for 2 hours so as to almost completely remove the moisture of the granules.

Procedure (2)

Potassium bromide in an amount of 40 g and 50 g of potassium hydrogen carbonate were pulverized in the same manner as in Procedure (1). Water was sprayed in an amount of 0.5 ml so as to granulate them and the resulting granules were dried at 65° C. for 5 minutes, followed by drying in vacuum at 40° C. for 2 hours so as to almost completely remove the moisture of the granules.

Procedure (3)

The granules prepared in the above-mentioned Procedures (1) and (2) were uniformly mixed up together by a mixer for 10 minutes in a room controlled to be 25° C. and not higher than 40% RH. Next, the resulting mixture was compression-tableted to make a tablet having a diameter of 3 cm by making use of a solidifying tablet machine modified of Tough-Press Collect 1527HU manufactured by Kikusui Mfg. Works, Inc., so that 50 pieces of tablet-shaped replenishment compositions for color negatives could be prepared by uniformly arranging the mixture.

The tableted compositions were each prepared in the same manner as before, except that the proportion of ammonium ions to the whole cation of the tableted composition was adjusted as shown in Table 2 and that the ferric potassium ethylenediamine tetraacetate monohydrate (A-III-35) or ferric potassium 3-propanediamine tetraacetate monohydrate (A-III-36), potassium hydrogen carbonate and potassium bromide were replaced in order by the same mols of ferric ammonium ethylenediamine tetraacetate dihydrate or ferric ammonium 3-propanediamine tetraacetate monohydrate, ammonium hydrogen carbonate and ammonium bromide.

One thousand mili liter of water was put in a beaker and was then controlled to be 25° C. While water was kept stirred with a magnetic stirrer, 5 pieces of the above-obtained compositions were put therein and the solubilities thereof were evaluated. On the other hand, 2 pieces of the above-obtained compositions were aged in a free state at 30° C. and 50% RH for 2 weeks and the appearance of the aged chemicals were observed with the eye. The evaluation criteria were the same as in Example 1.

TABLE 2

| No. | Bleaching agent (Exemplified compound) | Proportion of ammonium ions | Solubility | Preservability |
|---|---|---|---|---|
| 2-1 | (A-III-35) | 0% | ○ | ○ |
| 2-2 | " | 10% | ○ | ○ |
| 2-3 | " | 20% | ○ | ○ |
| 2-4 | " | 30% | ○ | Δ |
| 2-5 | " | 50% | ○ | Δ |
| 2-6 | " | 70% | Δ | Δ |
| 2-7 | " | 100% | Δ | Δ |
| 2-8 | (A-III-36) | 0% | ◎ | ○ |
| 2-9 | " | 10% | ◎ | ○ |
| 2-10 | " | 20% | ◎ | ○ |
| 2-11 | " | 30% | ○ | Δ |
| 2-12 | " | 50% | ○ | Δ |
| 2-13 | " | 70% | Δ | Δ |
| 2-14 | " | 100% | Δ | Δ |

It was proved from Table 2 that the solubility was particularly excellent when the proportion of ammonium ions was not more than 50 mol %. It was also proved that the above-mentioned effects were more remarkable than the cases where the proportion of ammonium ions were not more than 20 mol % and that the preservability was also particularly excellent.

Example 3

Sample 3-1

Ferric potassium 1,3-propanediamine tetraacetate monohydrate (A-III-36) of 120 g, potassium maleate (II-11) of 66 g and potassium bromide of 40 g were pulverized in the same manner as in Procedure (1) of Example 1, so as to granulate them. Water was sprayed in an amount of 3.0 ml. After granulating them, the resulting granules were dried at 65° C. for 7 minutes.

Sample 3-2

Ferric potassium 1,3-propanediamine tetraacetate monohydrate (A-III-36) of 120 g, maleic acid (II-5) of 40 g, potassium bromide of 40 g and potassium carbonate of 60 g were mixed up together and the resulting mixture thereof was then pulverized in the same manner as in Procedure (1) of Example 1, so as to granulate them. Water was sprayed in an amount of 3.0 ml. After granulating them, the resulting granules were dried at 65° C. for 7 minutes.

Sample 3-3

Ferric potassium 1,3-propanediamine tetraacetate monohydrate (A-III-36) of 120 g and maleic acid (II-5) of 40 g were pulverized in the same manner as in Procedure (1) of Example 1, so as to granulate them. Water was sprayed in an amount of 2.5 ml. After granulating them, the resulting granules were dried at 65° C. for 7 minutes. Besides the above, 40 g of potassium bromide and 50 g of potassium carbonate were pulverized in the same manner so as to granulate them. Water was sprayed in an amount of 0.5 ml. After granulating them, the resulting granules were dried at 65° C. for 5 minutes.

The granules prepared in the above-described procedures were each uniformly mixed up and tableted in the manner described in Procedure (3) of Example 1, so that 50 pieces of the tableted replenishing composition for bleaching color negatives.

One thousand mili liter of water was put in a beaker and was then controlled to be 25° C. While water was kept stirred with a magnetic stirrer, 5 pieces of the above-obtained compositions were put therein and the solubilities thereof were evaluated. The results thereof will be shown in Table 3. The evaluation criteria were the same as in Example 1.

TABLE 3

| No. | Potassium carbonate | Granulation method | Solubility |
|---|---|---|---|
| 3-1 | Not contained | Granulated | Δ |
| 3-2 | Contained | Mixed and granulated | ○ |
| 3-3 | " | Fractionally granulated | ◎ |

It was proved from Table 3 that the solubility of each tableted composition was improved by containing a carbonate. It was further proved that the solubility could more be improved when the organic acid represented by Formulas (II) and (III) and a carbonate were separately granulated and were then mixed up.

Example 4

The tableted compositions for processing color negative films were each prepared in the following procedures.

1) Tableted Replenishing Compositions for Color Developing Color Negatives

Procedure (1)

Developing agent CD-4 (4-amino-3-methyl-N-ethyl-β-(hydroxy)ethyl aniline sulfate) of 60 g was pulverized through an air-jet fine pulverizer so as to have an average particle size of 10 μm. The resulting fine powder was granulated by spraying 5.0 ml of water through a commercially available fluidized-bed spray granulator at room temperature for about 7 minutes. The resulting granules were dried at 63° C. for 8 minutes. Next, the dried granules were dried again in the vacuum condition at 40° C. for 2 hours, so that the moisture therein was almost completely removed.

Procedure (2)

Hydroxylamine sulfate of 60 g was pulverized in the same manner as in Procedure (1) and was then granulated by spraying 2.6 ml of water over them. After completing the granulation, the resulting granules were dried at 65° C. for 7 minutes. Next, the resulting dried granules were dried again in the vacuum conditions at 40 C for 2 hours, so that the moisture therein could be almost completely removed.

Procedure (3)

Disodium 1-hydroxyethane-1,1-diphosphonate of 58 g, sodium sulfite of 70 g, potassium carbonate of 618 g, sodium hydrogen carbonate of 30 g, sodium bromide of 6 g and diethylenetriamine pentaacetate of 40 g were each pulverized in the same manner as in Procedure (1). The resulting pulverized matters were uniformly mixed up by a commercially available mixer. Next, the resulting mixture was granulated in the same manner as in Procedure (1) by spraying 200 ml of water over them. After completing the granulation, they were dried at 65° C. for 15 minutes. Then, the resulting dried granules were dried again in the vacuum conditions at 40° C. for 2 hours, so that the moisture therein could be almost completely removed.

Procedure (4)

The granules prepared each in the above-described Procedures (1) through (3) were uniformly mixed up for 10 minuted by making use of a mixer in a room so controlled as to be 25° C. and 40% RH. Next, the resulting mixture was compression-tableted so that the filling amount per tablet could be 5.0 g by a tablet machine, a modified Tough Pressed Collect 1527HU manufactured by Kikusui Mfg. Works, Inc. Thereby 160 pieces of the tableted replenishing compositions for color developing color negatives were prepared.

2) Tableted Replenishing Compositions for Bleaching Color Negatives

Procedure (5)

Ferric potassium 1,3-propanediamine tetraacetate monohydrate (A-III-36) of 237 g, organic acid shown in Table 4 and represented by Formulas (II) and (III), and 1,3-propanediamine tetraacetate of 10 g were each pulverized and then granulated. After completing the granulation upon spraying 5.0 ml of water over them, the resulting granules were dried at 60° C. for 7 minutes. Next, the dried granules were dried again in the vacuum conditions at 40° C. for 2 hours so that the moisture therein could be almost completely removed.

Procedure (6)

Potassium bromide of 60 g and potassium carbonate of 60 g were each pulverized and granulated in the same manner as in Procedure (1). After completing the granulation upon spraying 1.0 ml of water, the resulting granules were dried at 70° C. for 3 minutes. Next, the dried granules were dried again in the vacuum conditions at 40° C. for 120 minutes so that the moisture therein was almost completely removed. The amount of the potassium carbonate was adjusted so as to meet the amount of organic acid added in Procedure (5) so that the pH could be constant when the resulting tablets were dissolved in water.

Procedure (7)

The granules prepared each in the above-described Procedures (5) and (6) were uniformly mixed up for 10 minuted by making use of a mixer in a room so controlled as to be 25° C. and 40% RH. Next, the resulting mixture was compression-tableted so that the filling amount per tablet could be 6.0 g by a tablet machine, a modified Tough Pressed Collect 1527HU manufactured by Kikusui Mfg. Works, Inc. Thereby 80 pieces of the tableted replenishing compositions for bleaching color negatives were prepared.

3) Tableted Replenishing Compositions for Fixing Color Negatives

Procedure (8)

Potassium thiosulfate of 950 g, sodium thiocyanate of 2020 g, sodium sulfite of 120 g, potassium carbonate of 150 g and disodium ethylenediamine tetraacetate of 10 g were each pulverized and granulated in the same manner as in Procedure (1). After completing the granulation upon spraying 30.0 ml of water over them, the resulting granules were dried at 65° C. for 60 minutes. Next, the resulting dried granules were dried again in the vacuum conditions at 40° C. for 480 minutes so that the moisture therein could be almost completely removed.

Procedure (9)

The granules prepared each in the above-described Procedure (8) were uniformly mixed up for 10 minuted by making use of a mixer in a room so controlled as to be 25° C. and 40% RH. Next, the resulting mixture was compression-tableted so that the filling amount per tablet could be 13.0 g by a tablet machine, a modified Tough Pressed Collect 1527HU manufactured by Kikusui Mfg. Works, Inc. Thereby 200 pieces of the tableted replenishing compositions for fixing color negatives were prepared.

4) Tableted Replenishing Compositions for Stabilizing Color Negatives

Procedure (10)

m-hydroxybenzaldehyde of 200 g, Emulgen 985 of 10 g and potassium carbonate of 45 g were each pulverized and granulated in the same manner as in Procedure (1). After completing the granulation upon spraying 3.0 ml of water over them, the resulting granules were dried in the vacuum conditions at 30° C. for 8 hours so that the moisture therein could be almost completely removed.

Procedure (11)

The granules prepared each in the above-described Procedure (10) were uniformly mixed up for 10 minuted by making use of a mixer in a room so controlled as to be 25° C. and 40% RH. Next, the resulting mixture was compression-tableted so that the filling amount per tablet could be 0.2 g by a tablet machine, a modified Tough Pressed Collect 1527HU manufactured by Kikusui Mfg. Works, Inc. Thereby 1060 pieces of the tableted replenishing compositions for fixing color negatives were prepared.

Each of the tableted processing compositions necessary to try the following running experiments by repeating the above-described procedures.

Next, the method of the invention for processing light sensitive materials through an automatic processor will be detailed below.

A Konica Color Negative Film Processor CL-KP-50QA was so modified as to be equipped with the following tablet composition supplying function, a liquid level detecting function and a water supplying function.

FIG. 1 is a schematic plan view showing one example of the automatic processors relating to the invention, wherein the control mechanism for the color negative film processing unit is schematically illustrated.

When a color negative film is introduced into light sensitive material inlet 13, passing through light sensitive material area detecting sensor 7 and then detecting a certain area thereof, solidified photographic processing composition replenishing device 8, water replenishing tank 10 and replenishment water supplying means 12 are each operated upon receipt of a signal given from control section 11, so that the solidified photographic processing compositions and replenishment water for preparing solutions are supplied to each of processing tanks 1, 2, 3 and 5 in a necessary amount, respectively.

When an automatic processor is temperature-controlled for several hours, the processing solutions in each of processing tanks 1 through 5 are evaporated. When solution surface levels are lowered to a certain level, solution level detecting sensor 9 is operated to make replenishment water tank 10 and replenishment water supplying means 12 function upon receipt of a signal from solution level sensor 9, so that water is replenished until the upper limit level detecting mechanism of solution level detecting sensor 9 is started to work. It is further desired to temperature-control both of replenishment water for compensating an evaporation and washing water 14 that is the replenishment water supplied through replenishment water supplying pipe 15. Among the processing tanks 1 through 5, 1 is a color developing tank, 2 is a bleaching tank, 3 is a fixing tank, 4 and 4 are washing tanks and 5 is a stabilizing tank, and 6 is a drying section.

Figure 2:
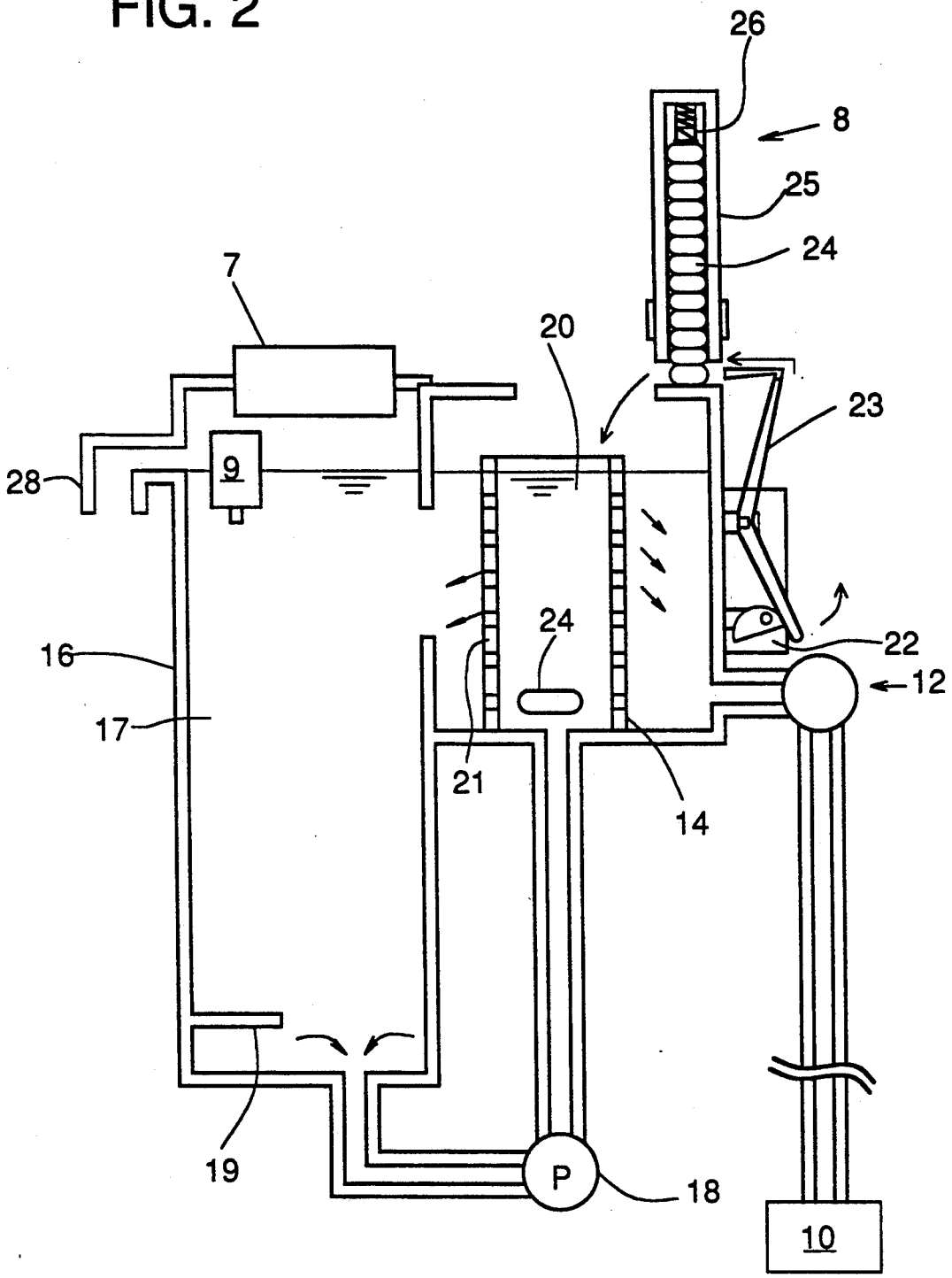
FIG. 2 is a schematic illustration showing one example of the replenishing sections for solidified processing compositions for replenishment.

FIG. 2 is a schematic illustration showing one example of solidified photographic processing composition supplying devices 8 for which the solidified photographic processing compositions are used in the form of solidified tablets.

Upon receipt of a signal given from light sensitive material area detecting sensor 7 and when control section 11 is operated and solidified photographic processing composition supplying cam 22 is then operated, solidified photographic processing composition pushing claw 23 supplies one or some tablets of solidified photographic processing compositions 24 stored in cartridge 25 into filtering device 21 provided in sub-tank 20 that is a solidified photographic composition dissolving section of each of processing tanks 1, 2, 3 and 5.

Solidified photographic processing composition 24 duly supplied is gradually dissolved and then supplied into main processing tank 16 by circulation pump 18.

The solubility of solidified photographic processing composition 24 can more be improved when the whole or major parts of the circulating current of processing solution 17, which is being circulated by circulation pump 18 between main processing tank 16 and sub-tank 20, is so constituted as to pass directly through filtering device 21 provided in sub-tank 20.

In the same figure, 19 is a thermostat heater; 26 is a pushing spring for compression-keeping solidified photographic processing composition 24 stored in cartridge 25; 27 is a communicating pipe communicating between main processing tank 16 and sub-tank 20 of each processing tank 1, 2, 3 and 5; and 28 is an overflow outlet.

When the level of processing solution 17 in any one of processing tanks 1 through 5 is lowered by evaporation in the course of keeping or stopping the temperature control of an automatic processor, solution level detecting sensor 9 detects the lowered level and sends a signal to control section 11 so as to operate replenishment water supplying means 12, so that replenishment water for compensating the evaporation is supplied up to the regular solution level. When the water replenishment reaches the regular level, solution level detecting sensor 9 detects the regular level and sends a signal to control section 11 so as to stop the operation of replenishment water supplying means 12.

The following table shows the standard processing conditions for an automatic processor.

| Processing step | Processing temperature | Processing time |
|---|---|---|
| Color developing | 38.0 ± 0.3° C. | 3 min. 15 sec. |
| Bleaching | 38.0 ± 1.0° C. | 45 sec. |
| Fixing - 1 | 38.0 ± 1.0° C. | 45 sec. |
| Fixing - 2 | 38.0 ± 1.0° C. | 45 sec. |
| Stabilizing - 1 | 38.0 ± 3.0° C. | 20 sec. |
| Stabilizing - 2 | 38.0 ± 3.0° C. | 20 sec. |
| Stabilizing - 3 | 38.0 ± 3.0° C. | 20 sec. |
| Drying | 60° C. | 60 sec. |

The fixer is replenished into the second tank and the overflow therefrom flows into the first tank. The stabilizer is replenished into the third tank and the overflow therefrom flows into the second and first tanks in order. This system is called a cascade system.

The processing solutions used in the automatic processor were prepared in the following procedures.

(1) Color developing tank solution (in 21.0 liters)

Into the color developing tank for the automatic processor, 15 liters of water warmed at 35° C. was put and 399 pieces of the tableted replenishing compositions for color developing color negative films were then put and dissolved in. Next, 21 pieces of the starters having the following composition formula separately tableted in advance were put in as a starter component and were then completely dissolved therein. After that, warm water was added up to the marked line of the tank, so that the tank solution could be completed.

| Color developing starter for color negatives | |
|---|---|
| Sodium bromide | 0.8 g |
| Sodium iodide | 2.0 mg |
| Sodium hydrogen carbonate | 3.0 g |
| Potassium carbonate | 0.5 g |

(2) Bleaching Solution (in 5.0 Liters)

Into a bleaching tank for the automatic processor, 3.0 liters of water warmed at 35° C. was put in and 350 pieces of tableted replenishing compositions for bleaching color negative films were put in and were then dissolved therein. Next, 10 pieces of the starters having the following composition formula separately tableted in advance were put in as a starter component and were then completely dissolved therein. After that, warm water was added up to the marked line of the tank, so that the tank solution could be completed.

| Bleaching starter for color negatives | |
|---|---|
| Potassium bromide | 10 g |
| Sodium hydrogen carbonate | 1.5 g |
| Potassium carbonate | 3.5 g |

(3) Fixing Solution (in 4.5 Liters Each for Tank Nos. 1 & 2)

Into fixing tanks Nos. 1 and 2, 3.0 liters each of water warmed at 35° C. were added and 112 pieces of tableted replenishing compositions for fixing color negative films were put in and were then dissolved therein. Next, warm water was added up to each marked line of the tanks, so that the tank solution could be completed.

(4) Stabilizing Solution (3.2 Liters Each for Tank Nos. 1 to 3)

Into stabilizing tanks Nos. 1 and 2 for the automatic processor, 3.0 liters each of water warmed at 35° C. were added and 40 pieces of tableted replenishing compositions for stabilizing the prepared color negative films were put in and were then dissolved therein. Next, warm water was added up to each marked line of the tanks, so that the tank solution could be completed.

To the overflow reservoir tank, the system was so provided as to put 1 liter of a solution having the same compositions as those of the color developing solution therein and then to introduce the overflow from the reservoir tank into a waste solution collecting tank when 1 liter or more of an overflow is reserved in the tank.

Each of 20 pieces of the tableted replenishing compositions prepared in the above-described procedures were set to the tableted replenishing composition supplying device provided to the automatic processor in the course of controlling the temperature of the automatic processor. The setting was so arranged as to put one each of the tableted replenishing compositions into the overflow reservoir tank and, at the same time, to supply 40 ml of warmed replenishing water into the color developing tank, 10 ml thereof into the fixing tank and 80 ml thereof into the stabilizing tank respectively from a warmed water supplying tank, when every 2 rolls of 135 size, 24 exposure film were processed.

Color negative films, DD-100 (manufactured by Konica Corp.) were used for the tests.

The light sensitive material samples were exposed wedgewise to light in an ordinary method and were then running-processed. The running processes were continuously carried out until replenishing the amount twice as much as the capacity of the bleaching tank (in 2R).

Of the processed photographic light sensitive materials, the residual silver contents in the maximum color developed area thereof were each measured. Also, the densities of the processed samples were each measured and the Dmin values of the blue and green rays of light (Blue and Green) were each measured. Further, the processed samples were each cut in half and each one of them was processed again in the formula of the following reprocessing solution. The samples were dipped in the processing solution at 35° C. for 6 min. 30 sec.

Reprocessing Solution

Ferric ammonium ethylenediamine tetraacetate monohydrate was added by water to make 1.0 liter and the pH was adjusted with aqueous ammonia to be 6.0.

In the Dmax areas each of the reprocessed sample, red rays of light (Red) were measured. The differences between the Red rays and the Dmax densities obtained, before the samples were reprocessed, are each hereinafter called a leuco dye formation (ΔDmax).

*Leuco dye formation (ΔDmax)=(Dmax before reprocessed)−(Dmax after reprocessed)*

The results thereof will be given in Table 4 below.

TABLE 4

| No. | Organic acid (Exemplified compound) & amount added | Residual silver amt. (mg/100 cm$^2$) | Leuco dye formation ΔDmax | Dmin density Blue | Dmin density Green |
|---|---|---|---|---|---|
| 4-1 | None | 0.2 | 0.01 | 0.77 | 0.68 |
| 4-2 | Sodium acetate, 50 g | 0.5 | 0.05 | 0.73 | 0.65 |
| 4-3 | Sodium acetate, 100 g | 1.2 | 0.21 | 0.70 | 0.63 |
| 4-4 | (II-5), 50 g | 0.2 | 0.00 | 0.64 | 0.58 |
| 4-5 | (II-5), 100 g | 0.3 | 0.02 | 0.62 | 0.56 |
| 4-6 | (II-6), 50 g | 0.3 | 0.01 | 0.64 | 0.57 |
| 4-7 | (II-6), 100 g | 0.4 | 0.02 | 0.62 | 0.56 |
| 4-8 | (II-5), 50 g & | 0.3 | 0.02 | 0.61 | 0.55 |
| | (II-6), 50 g | 0.3 | 0.02 | 0.61 | 0.55 |
| 4-9 | (II-16), 100 g | 0.3 | 0.02 | 0.62 | 0.55 |
| 4-10 | (II-17), 100 g | 0.4 | 0.03 | 0.63 | 0.57 |
| 4-11 | (II-18), 100 g | 0.3 | 0.03 | 0.63 | 0.58 |
| 4-12 | (II-19), 100 g | 0.4 | 0.03 | 0.63 | 0.58 |
| 4-13 | (II-20), 100 g | 0.5 | 0.04 | 0.67 | 0.60 |
| 4-14 | (III-4), 100 g | 0.4 | 0.03 | 0.66 | 0.59 |

It was proved from the contents of Table 4 that, in the processing method in which the bleaching compositions of the invention were used, bleach fog could be reduced and bleaching characteristics could also be excellent.

Example 5

When the running experiments were each tried in the same manner as in Example 4, except that ferric potassium 1,3-propanediamine tetraacetate that was the bleaching agent (A-III-36) used in Example 4 was replaced by (A-I-2), (A-II-1) and (A-II-3) respectively, the excellent processing characteristics could be displayed, except that the residual silver contents were increased by the order of 20 to 30%.

In the same experiments except that the above-mentioned bleaching agents of the invention were replaced by (A-IV-8), (A-V-13) and (A-VI-4) respectively, the almost excellent processing characteristics could be displayed, except that the residual silver contents and the color recurring characteristics were further deteriorated in some extent.

Example 6

The running experiments were tried in the same manner as in Example 4 by making use of the same light sensitive materials as used in Example 4, except that the processing conditions were changed as follows.

| Processing step | Processing temperature | Processing time |
|---|---|---|
| Color developing | 38.0 ± 0.3° C. | 3 min. 15 sec. |
| Bleaching | 38.0 ± 1.0° C. | 45 sec. |
| Fixing - 1 | 38.0 ± 1.0° C. | 45 sec. |
| Fixing - 2 | 38.0 ± 1.0° C. | 45 sec. |
| Stabilizing - 1 | 38.0 ± 3.0° C. | 20 sec. |
| Stabilizing - 2 | 38.0 ± 3.0° C. | 20 sec. |
| Stabilizing - 3 | 38.0 ± 3.0° C. | 20 sec. |
| Drying | 60° C. | 60 sec. |

In the experiments, the following system was used; the bleacher and fixer were replenished into a bleaching tank and a fixing tank respectively, and the overflows from the both tanks were flowed into a bleach-fixing tank. Also, the cascade system was also applied in which the stabilizer was replenished into the third tank and the overflow therefrom was flowed into the second tank and then into the first tank in order.

For these experiments, each of the same experiment levels as in Nos. 4-5, 4-8 and 4-9 each tried in Example 4 were evaluated. The excellent results were also obtained as same as shown in Table 4.

Further, the above experiment was repeated by using a replenishing bleaching solution in which tableted bleaching compositions have been dissolved in water, and excellent results were obtained as in the above.

Example 7

The tableted compositions for processing color paper were prepared in the following procedures.

1) Tableted Replenishing Compositions for Color Developing Color Paper

Procedure (A)

Developing agent CD-3 (4-amino-3-methyl-N-ethyl-N-(β-(methanesulfonamido)ethyl) aniline sulfate) of 100 g was pulverized through an air-jet fine pulverizer so as to have an average particle size of 10 μm. The resulting fine powder was granulated by spraying 4.5 ml of water through a commercially available fluidized-bed spray granulator at room temperature for about 5 minutes. The resulting granules were dried at 65° C. for 8 minutes. Next, the dried granules were dried again in the vacuum condition at 40° C. for 2 hours, so that the moisture therein was almost completely removed.

Procedure (B)

Diethylhydroxylamine oxalate of 185 g was pulverized in the same manner as in Procedure (A) and was then granulated by spraying 3.0 ml of water over them. After completing the granulation, the resulting granules were dried at 50° C. for 10 minutes. Next, the resulting dried granules were dried again in the vacuum conditions at 40° C. for 2 hours, so that the moisture therein could be almost completely removed.

Procedure (C)

Cinopal SFP (manufactured by Ciba-Geigy AG) of 30.0 g, sodium sulfite of 3.7 g, potassium carbonate of 500 g, potassium bromide of 0.3 g, diethylenetriamine pentaacetate of 25 g, sodium p-toluenesulfonate of 100 g and potassium hydroxide of 200 g were each pulverized in the same manner as in Procedure (A). The resulting pulverized matters were uniformly mixed up by a commercially available mixer. Next, the resulting mixture was granulated in the same manner as in Procedure (A) by spraying 200 ml of water over them. After completing the granulation, they were dried at 65° C. for 15 minutes. Then, the resulting dried granules were dried again in the vacuum conditions at 40° C. for 2 hours, so that the moisture therein could be almost completely removed.

Procedure (D)

The granules prepared each in the above-described Procedures (A) through (C) were uniformly mixed up for 10 minutes by making use of a mixer in a room so controlled as to be 25° C. and 40% RH or lower. Next, the resulting mixture was compression-tableted so that the filling amount per tablet could be 5.86 g by a tablet machine, a modified Tough Pressed Collect 1527HU manufactured by Kikusui Mfg. Works, Inc. Thereby 150 pieces of the tableted replenishing compositions for color paper were prepared.

2) Tableted replenishing compositions for stabilizing color paper

Procedure (H)

Potassium carbonate of 10 g and sodium 1-hydroxyethane-1,1-diphosphonate of 200 g were pulverized and granulated in the same manners as in Procedure (A). After they were granulated by spraying 1.0 ml of water over them, they were dried at 70° C. for 3 minutes. Next, the dried granules were dried again in the vacuum condition at 40° C. for 2 hours, so that the moisture therein were almost completely removed.

Procedure (I)

Cinopal SFP (manufactured by Ciba-Geigy AG) of 150 g, sodium sulfite of 300 g, zinc sulfite septihydrate of 20 g and ethylenediamine tetraacetate of 150 g were each pulverized and granulated in the same manner as in Procedure (A). After they were granulated by spraying 10.0 ml of water over them, they were dried at 65° C. for 5 minutes. Then, the resulting dried granules were dried again in the vacuum conditions at 40° C. for 8 hours, so that the moisture therein could be almost completely removed.

Procedure (J)

The granules prepared each in the above-described Procedures (H) and (I) were uniformly mixed up for 10 minutes by making use of a mixer in a room so controlled as to be 25° C. and 40% RH or lower. Next, the resulting mixture was compression-tableted so that the filling amount per tablet could be 0.66 g by a tablet machine, a modified Tough Pressed Collect 1527HU manufactured by Kikusui Mfg. Works, Inc. Thereby 1000 pieces of the tableted replenishing compositions for color paper were prepared.

Next, a Konica Color Paper Type QA Processor CL-PP-718 was so modified as to be equipped with a tableted composition supplying function, a liquid level detecting function and a warm water supplying function. And, the following processing experiments were tried with the above-modified processor. The standard processing conditions for the automatic processor will be given in the table below.

| Processing step | Processing temperature | Processing time |
|---|---|---|
| Color developing | 35 ± 0.3° C. | 45 sec. |
| Bleaching | 35 ± 1.0° C. | 20 sec. |
| Fixing | 33 ± 1.0° C. | 30 sec. |
| Stabilizing - 1 | 33 ± 3.0° C. | 30 sec. |

-continued

| Processing step | Processing temperature | Processing time |
|---|---|---|
| Stabilizing - 2 | 33 ± 3.0° C. | 30 sec. |
| Drying | 72 ± 5.0° C. | 40 sec. |

A cascade system was applied to the experiments, in which the stabilizer was replenished into the second tank and so forth in order and the overflow therefrom was flowed into the fixing tank.

The processing solutions for automatic processor use were prepared in the following procedures.

(1) Color developing tank solution (in 23.0 liters)

Warmed water kept at 35° C. of 18 liters was put in the color developing tank of an automatic processor and 314 pieces of tableted replenishing compositions for color developing color paper were then put therein and dissolved. Next, 23 pieces of the starter having the following composition separately tableted in advance as the starter components and then dissolved therein. After dissolving them, warmed water was added up to the marked line so that a tank solution was completed.

| Starter for color devloping color paper | |
|---|---|
| Potassium chloride | 4.0 g |
| Potassium hydrogen carbonate | 4.8 g |
| Potassium carbonate | 2.1 g |

(2) Bleaching Solution (in 15.0 Liters)

Into a bleaching tank of the automatic processor, 10.0 liters of water warmed at 35° C. was added and 700 pieces of tableted replenishing compositions for bleaching color negative film were put therein and dissolved. Next, 20 pieces of the tableted starter compositions for starting a bleaching reaction prepared in Example 4 were put therein. After completely dissolved, warmed water was added up to the marked line so that a tank solution was completed.

(3) Fixing solution (in 15.0 liters)

Into a fixing tank of an automatic processor, 10.0 liters of water warmed at 35° C. was added therein and 120 pieces of the tableted replenishing compositions for fixing color negative films prepared in Example 4 were put therein and dissolved. Next, warmed water was added up to the marked line so that a tank solution was completed.

(4) Stabilizing Solution (in 1.5 liters each in the First and Second Tanks)

Into the first and second stabilizing tanks of the automatic processor, 12.0 liters each of water warmed at 35° C. were put in and 60 pieces each of the tableted replenishing compositions for stabilizing color paper were put in and dissolved therein. Next, warmed water was added up to the marked line so that a tank solution was completed.

Next, 20 pieces each of the tableted replenishing compositions were set on the tableted replenishing composition supplying device provided to the automatic processor. One piece each of these tableted replenishing compositions was put therein every time when 3200 $cm^2$ of color paper was processed and, at the same time, 40 ml of replenishment warmed water was supplied to the color developing tank, 10 ml thereof to the bleaching tank, 40 ml thereof to the fixing tank and 80 ml thereof to the stabilizing tank, respectively from the warmed water supplying device.

Color paper prepared in the procedures described in the example given in JP Application No. 3-47516/1991 was exposed wedgewise to light in an ordinary method and was then running-processed in the foregoing processing steps. However, the running processes were carried out continuously until the amount replenished was added as twice as much as the capacity of the bleaching tank (2R).

Of each of the processed photographic light sensitive materials, the residual silver contents, color recurring property and bleach-fogginess thereof were each evaluated in the same manners as in Example 4. The results thereof will be given in Table 7 below.

TABLE 7

| No. | Organic acid (Exemplified compound) & amount added | Residual silver amt. (mg/100 $cm^2$) | Leuco dye formation ΔDmax | Dmin density Blue | Dmin density Green | Remarks |
|---|---|---|---|---|---|---|
| 7-1 | None | 0.1 | 0.00 | 0.11 | 0.08 | Comp. |
| 7-2 | Potassium acetate, 50 g | 0.2 | 0.03 | 0.06 | 0.05 | " |
| 7-3 | Potassium acetate, 100 g | 0.3 | 0.07 | 0.04 | 0.03 | " |
| 7-4 | (II-5), 50 g | 0.1 | 0.01 | 0.02 | 0.02 | Inv. |
| 7-5 | (II-5), 100 g | 0.1 | 0.01 | 0.01 | 0.01 | " |
| 7-6 | (II-6), 50 g | 0.1 | 0.00 | 0.03 | 0.02 | " |
| 7-7 | (II-6), 100 g | 0.2 | 0.02 | 0.01 | 0.01 | " |
| 7-8 | (II-5, 50 g & (II-6), 50 g | 0.1 | 0.01 | 0.01 | 0.01 | " |
| 7-9 | (II-16), 100 g | 0.1 | 0.01 | 0.01 | 0.01 | " |
| 7-10 | (II-17), 100 g | 0.2 | 0.02 | 0.02 | 0.01 | " |
| 7-11 | (II-18), 100 g | 0.1 | 0.01 | 0.02 | 0.01 | " |
| 7-12 | (II-19), 100 g | 0.1 | 0.02 | 0.01 | 0.01 | " |
| 7-13 | (II-20), 100 g | 0.2 | 0.03 | 0.02 | 0.02 | " |
| 7-14 | (III-4), 100 g | 0.2 | 0.03 | 0.02 | 0.02 | " |

It was proved from the contents of Table 7 that, in the processing method in which the bleaching compositions of the invention were used, bleach fog could be reduced and bleaching characteristics could also be excellent.

What is claimed is:

1. A solid composition for bleaching an exposed and developed silver halide color photographic light-sensitive material comprising a support and provided thereon, a silver halide emulsion layer, the composition being in the form of a tablet having a bulk density of 1.0 to 2.5 $g/cm^3$ and containing a ferric complex salt of a compound represented by the following Formula (A-I), (A-II), (A-IV), (A-V) or (A-VI) and a compound represented by the following Formula (II) or (III):

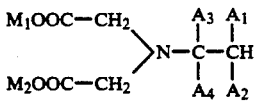

Formula (A-I)

wherein $A_1$, $A_2$, $A_3$ and $A_4$ independently represent a hydrogen atom, a hydroxyl group, a lower alkyl group, —COOM, —$PO_3(M_1)_2$, —$CH_2COOM_2$ or —$CH_2OH$, provided that at least one of $A_1$, $A_2$, $A_3$ and $A_4$ represents —COOM, —$PO_3(M_1)_2$, or —$CH_2COOM_2$, wherein M, $M_1$, and $M_2$ independently represent a hydrogen atom, an alkali metal, an ammonium group or an organic ammonium group;

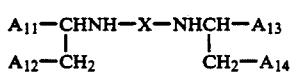

Formula (A-II)

wherein $A_{11}$, $A_{12}$, $A_{13}$ and $A_{14}$ independently represent —$CH_2OH$, —$COOM_3$ or —$PO_3(M_4)_2$; $M_3$ and $M_4$ independently represent a hydrogen atom, an ammonium group, an alkali metal or an organic ammonium group; and X represents an alkylene group having 2 to 6 carbon atoms or —$(B_1O)_n$—$B_2$— wherein n is an integer of 1 to 8, and $B_1$ and $B_2$ independently represent an alkylene group having 1 to 5 carbon atoms;

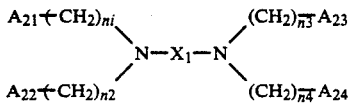

[Formula (A-III)

wherein $A_{21}$, $A_{22}$, $A_{23}$ and $A_{24}$ independently represent —$CH_2OH$, —$COOM_5$ or —$PO_3(M_6)_2$; $M_5$ and $M_6$ independently represent a hydrogen atom, an alkali metal, an ammonium group or an organic ammonium group; $X_1$ represents an alkylene group having 2 to 6 carbon atoms, a divalent cyclic organic group or —$(B_{11}O)n_5$—$B_{12}$— wherein $n_5$ is an integer of 1 to 8, and $B_{11}$ and $B_{12}$ independently represent an alkylene group having 1 to 5 carbon atoms; and $n_1$, $n_2$, $n_3$ and $n_4$ independently represent an integer of 1 or more;

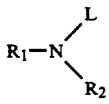

Formula (A-IV)

wherein $R_1$ and $R_2$ independently represent a hydrogen atom, an alkyl group or an aryl group; and L represents a group selected from the group consisting of

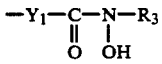

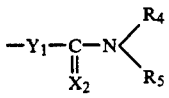

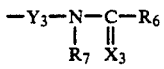

wherein $Y_1$, $Y_2$ and $Y_3$ independently represent an alkylene group or an arylene group; $X_2$ and $X_3$ independently represent an oxygen atom or a sulfur atom; and $R_3$, $R_4$, $R_5$, $R_6$ and $R_7$ independently represent a hydrogen atom, an alkyl group or an aryl group;

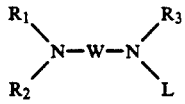

Formula (A-V)

wherein $R_1$, $R_2$ and $R_3$ independently represent a hydrogen atom, an alkyl group or an aryl group; L is the same with those denoted in Formula (A-IV); and W represents a divalent linking group;

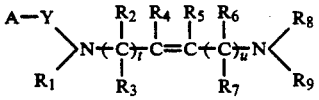

Formula (A-VI)

wherein $R_1$, $R_2$, $R_3$, $R_6$, $R_7$, $R_8$ and $R_9$ independently represent a hydrogen atom, an alkyl group or an aryl group; $R_4$ and $R_5$ independently represent a hydrogen atom, a halogen atom, a cyano group, a nitro group, an acyl group, a sulfamoyl group, a carbamoyl group, an alkoxycarbonyl group, an allyloxy-carbonyl group, a sulfonyl group, a sulfinyl group, an alkyl group or an aryl group, provided that $R_4$ and $R_5$ may be combined to form a 5- or 6-membered ring; A represents a carboxyl group, a phosphono group, a sulfo group, a hydroxyl group of an alkali metal salt or ammonium salt thereof; Y represents an alkylene group or an arylene group; and t and u independently represent an integer of 0 or 1;

$X_2$—$A_2$—$COOM_2$ Formula (II)

wherein $X_2$ represents a halogen atom, an amino group, a hydroxyl group, a methoxy group, —$COOM_2$ or —$SO_3M_2$; and $A_2$ represents an alkylene group, an alkenylene group or an arylene groups; and $M_2$ represents a hydrogen atom, an alkali metal, an ammonium group or an organic ammonium group;

$NH_2$—$A_3$—$SO_3M_3$ Formula (III)

wherein $A_3$ represents an alkylene group, an alkenylene group or an arylene group; and $M_3$ represents a hydrogen atom, an alkali metal, an ammonium group or an organic ammonium group.

2. The solid composition of claim 1, containing an ammonium ion in an amount of not more than 50 mol % based on the total cations.

3. The solid composition of claim 1, containing an ammonium ion in an amount of not more than 20 mol % based on the total cations.

4. The solid composition of claim 1, further containing a carbonate or bicarbonate.

5. The solid composition of claim 1, wherein the composition contains a ferric complex salt of a compound represented by said Formula (A-I) or (A-II) and said compound represented by said Formula (II) or (III).

6. A process of processing a silver halide color photographic light-sensitive material comprising a support and provided thereon, a silver halide emulsion layer, comprising the steps of:

exposing the material;

developing the exposed material;

bleaching the developed material with a bleacher; and replenishing the bleacher by supplying a replenishing bleaching composition, wherein said composition is a solid composition being in the form of a tablet having a bulk density of 1.0 to 2.5 g/cm$^3$ and containing a ferric complex salt of a compound represented by the following Formula (A-I), (A-II), (A-IV), (A-V) or (A-VI) and a compound represented by the following Formula (II) or (III):

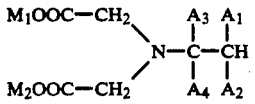

Formula (A-I)

wherein $A_1$, $A_2$, $A_3$ and $A_4$ independently represent a hydrogen atom, a hydroxyl group, a lower alkyl group, —COOM, —$PO_3(M_1)_2$, —$CH_2COOM_2$ or —$CH_2OH$, provided that at least one of $A_1$, $A_2$, $A_3$ and $A_4$ represents —COOM, —$PO_3(M_1)_2$, or —$CH_2COOM_2$, wherein M, $M_1$, and $M_2$ independently represent a hydrogen atom, an alkali metal, an ammonium group or an organic ammonium group;

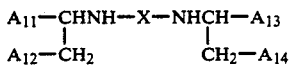

Formula (A-II)

wherein $A_{11}$, $A_{12}$, $A_{13}$ and $A_{14}$ independently represent —$CH_2OH$, —$COOM_3$ or —$PO_3(M_4)_2$; $M_3$ and $M_4$ independently represent a hydrogen atom, an ammonium group, an alkali metal or an organic ammonium group; and X represents an alkylene group having 2 to 6 carbon atoms or —$(B_1O)_n$—$B_2$— wherein n is an integer of 1 to 8, and $B_1$ and $B_2$ independently represent an alkylene group having 1 to 5 carbon atoms;

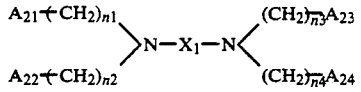

Formula (A-III)

wherein $A_{21}$, $A_{22}$, $A_{23}$ and $A_{24}$ independently represent —$CH_2OH$, —$COOM_5$ or —$PO_3(M_6)_2$; $M_5$ and $M_6$ independently represent a hydrogen atom, an alkali metal, an ammonium group or an organic ammonium group; $X_1$ represents an alkylene group having 2 to 6 carbon atoms, a divalent cyclic organic group or —$(B_{11}O)_{n_5}$—$B_{12}$— wherein $n_5$ is an integer of 1 to 8, and $B_{11}$ and $B_{12}$ independently represent an alkylene group having 1 to 5 carbon atoms; and $n_1$, $n_2$, $n_3$ and $n_4$ independently represent an integer of 1 or more;

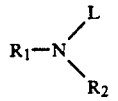

wherein $R_1$ and $R_2$ independently represent a hydrogen atom, an alkyl group or an aryl group; and L represents a group selected from the group consisting of

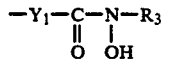

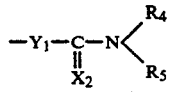

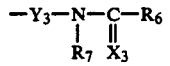

wherein $Y_1$, $Y_2$ and $Y_3$ independently represent an alkylene group or an arylene group; $X_2$ and $X_3$ independently represent an oxygen atom or a sulfur atom; and $R_3$, $R_4$, $R_5$, $R_6$ and $R_7$ independently represent a hydrogen atom, an alkyl group or an aryl group;

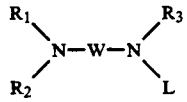

Formula (A-V)

wherein $R_1$, $R_2$ and $R_3$ independently represent a hydrogen atom, an alkyl group or an aryl group; L is the same with those denoted in Formula (A-IV); and W represents a divalent linking group;

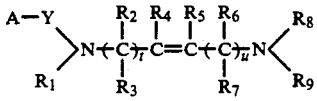

Formula (A-VI)

wherein $R_1$, $R_2$, $R_3$, $R_6$, $R_7$, $R_8$ and $R_9$ independently represent a hydrogen atom, an alkyl group or an aryl group; $R_4$ and $R_5$ independently represent a hydrogen atom, a halogen atom, a cyano group, a nitro group, an acyl group, a sulfamoyl group, a carbamoyl group, an alkoxycarbonyl group, an allyloxy-carbonyl group, a sulfonyl group, a sulfinyl group, an alkyl group or an aryl group, provided that $R_4$ and $R_5$ may be combined to form a 5- or 6-membered ring; A represents a carboxyl group, a phosphono group, a sulfo group, a hydroxyl group of an alkali metal salt or ammonium salt thereof; Y represents an alkylene group or an arylene group; and t and u independently represent an integer of 0 or 1;

$X_2$—$A_2$—$COOM_2$ Formula (II)

wherein $X_2$ represents a halogen atom, an amino group, a hydroxyl group, a methoxy group, —$COOM_2$ or —$SO_3M_2$; and $A_2$ represents an alkylene group, an alkenylene group or an arylene groups; and $M_2$ represents a hydrogen atom, an alkali metal, an ammonium group or an organic ammonium group;

$NH_2$—$A_3$—$SO_3M_3$ Formula (III)

wherein $A_3$ represents an alkylene group, an alkenylene group or an arylene group; and $M_3$ represents a hydrogen atom, an alkali metal, an ammonium group or an organic ammonium group.

7. The process of claim 6, further comprising dissolving said solid composition in water to obtain a replenishing bleaching solution for said replenishing bleaching composition.

* * * * *

UNITED STATES PATENT AND TRADEMARK OFFICE

CERTIFICATE OF CORRECTION

PATENT NO. : 5,316,898

DATED : May 31, 1994

INVENTOR(S) : Yutaka UEDA

It is certified that error appears in the above-identified patent and that said Letters Patent is hereby corrected as shown below:

Claim 1, column 49, DELETE LINES 30-46 IN THEIR ENTIRETY

Claim 6, column 51, DELETE LINES 42-59 IN THEIR ENTIRETY.

Claim 6, column 51, line 60 insert --Formula (A-IV)--.

Signed and Sealed this

Eleventh Day of April, 1995

*Attest:*

*Attesting Officer*

BRUCE LEHMAN

*Commissioner of Patents and Trademarks*